US009037009B2

(12) United States Patent
Ikeda

(10) Patent No.: US 9,037,009 B2
(45) Date of Patent: May 19, 2015

(54) IMAGE FORMING APPARATUS HAVING INDIVIDUALLY CONTROLLED ROTATING MEMBERS

(75) Inventor: Yoshimichi Ikeda, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 55 days.

(21) Appl. No.: 13/605,110

(22) Filed: Sep. 6, 2012

(65) Prior Publication Data

US 2013/0084086 A1 Apr. 4, 2013

(30) Foreign Application Priority Data

Sep. 30, 2011 (JP) ..... 2011-218317

(51) Int. Cl.
*G03G 15/00* (2006.01)
*G03G 15/01* (2006.01)
*G03G 15/16* (2006.01)

(52) U.S. Cl.
CPC ..... *G03G 15/0189* (2013.01); *G03G 15/167* (2013.01); *G03G 2215/0129* (2013.01); *G03G 2215/0158* (2013.01)

(58) Field of Classification Search
CPC ..... G03G 2215/00367
USPC ..... 399/36, 167
See application file for complete search history.

(56) References Cited

U.S. PATENT DOCUMENTS 4,058,041 A * 11/1977 Ito ..... 83/305
4,471,272 A * 9/1984 Ohno ..... 318/7
4,723,145 A * 2/1988 Takada et al. ..... 399/36
4,872,037 A * 10/1989 Kasahara et al. ..... 399/301
4,933,727 A * 6/1990 Mizuma et al. ..... 399/298
4,967,237 A * 10/1990 Sasaki et al. ..... 399/322
5,164,783 A * 11/1992 Taguchi et al. ..... 399/301
5,287,160 A * 2/1994 Dastin et al. ..... 399/301
5,331,341 A * 7/1994 Egawa et al. ..... 347/261
5,365,324 A * 11/1994 Gu et al. ..... 399/299
5,515,154 A * 5/1996 Hasegawa et al. ..... 399/303
5,782,560 A * 7/1998 Hatanaka et al. ..... 366/298
6,351,622 B1 * 2/2002 Sadowara ..... 399/167
6,445,900 B2 * 9/2002 Fukao et al. ..... 399/302
6,658,954 B1 * 12/2003 Bosa et al. ..... 74/409
7,319,839 B2 * 1/2008 Ishii et al. ..... 399/328

(Continued)

FOREIGN PATENT DOCUMENTS

JP 2655603 B2 9/1997
JP 2006-323235 A 11/2006

*Primary Examiner* — G. M. Hyder
(74) *Attorney, Agent, or Firm* — Fitzpatrick, Cella, Harper & Scinto

(57) ABSTRACT

An apparatus includes a first rotation member, a second rotation member that rotates while being in indirect contact with the first rotation member via a medium or being in direct contact with the first rotation member without the medium, a first drive motor that drives the first rotation member, and a second drive motor that drives the second rotation member. In addition, a first control unit controls the first drive motor to cause the first rotation member to rotate at a constant rotation frequency, a second control unit controls the second drive motor, and a rotation frequency detection unit detects a rotation frequency of the second drive motor. The second control unit is configured to control a rotation frequency of the second drive motor based on the detected rotation frequency of the second drive motor such that the second rotation member is driven to accompany the first rotation member.

18 Claims, 13 Drawing Sheets

(56) References Cited

U.S. PATENT DOCUMENTS

| | | | | |
|---|---|---|---|---|
| 7,522,863 | B2 * | 4/2009 | Reichert et al. | 399/167 |
| 2003/0190173 | A1 * | 10/2003 | Suzuki et al. | 399/302 |
| 2004/0000829 | A1 * | 1/2004 | McVicar | 310/114 |
| 2006/0288827 | A1 * | 12/2006 | Ishibuchi et al. | 83/13 |
| 2008/0080911 | A1 * | 4/2008 | Ishii et al. | 399/329 |
| 2009/0111638 | A1 * | 4/2009 | Terada | 475/221 |
| 2009/0237026 | A1 * | 9/2009 | Panaitescu et al. | 318/630 |
| 2009/0304411 | A1 * | 12/2009 | Mochizuki | 399/101 |
| 2010/0008689 | A1 * | 1/2010 | Iwasaki et al. | 399/66 |
| 2010/0226700 | A1 * | 9/2010 | Yamada et al. | 399/329 |
| 2010/0239293 | A1 * | 9/2010 | Ishizaki et al. | 399/66 |
| 2010/0303512 | A1 * | 12/2010 | Kamekura et al. | 399/301 |
| 2011/0064500 | A1 * | 3/2011 | Takahashi | 399/396 |
| 2011/0129241 | A1 | 6/2011 | Tomioka et al. | |
| 2011/0222886 | A1 * | 9/2011 | Tsukioka | 399/68 |
| 2011/0229163 | A1 * | 9/2011 | Ishizaki | 399/36 |
| 2012/0070168 | A1 * | 3/2012 | Ishizaki | 399/36 |
| 2013/0025423 | A1 * | 1/2013 | Nakano | 83/76 |

* cited by examiner

IMAGE FORMING APPARATUS HAVING INDIVIDUALLY CONTROLLED ROTATING MEMBERS

BACKGROUND OF THE INVENTION

1. Field of the Invention

The present invention relates to technology for reducing image defects, such as smeared images and color misregistration, in a multicolor image forming apparatus.

2. Description of the Related Art

As compared to a rotary method which uses a single photosensitive drum and a rotary unit having a plurality of image developing units, a tandem method accelerates the speed of image formation by forming toner images of different colors in parallel using a plurality of image forming stations. On the other hand, as the tandem method uses a plurality of photosensitive members and a plurality of optical devices, it triggers color misregistration and unevenness of color unless correction is made in accordance with variations in attachment of the photosensitive members and the optical devices and mechanical changes that occur over time. The color misregistration and unevenness of color make it difficult to obtain multicolor images with good quality.

Japanese Patent No. 2655603 proposes reduction of color misregistration by forming toner patches of different colors on an intermediate transfer belt, detecting positions of the toner patches with a sensor, and changing the timings at which toner images of different colors are applied to the intermediate transfer belt in accordance with the result of detection. Note that the toner patches denote unfixed toner images used to detect color misregistration.

Incidentally, with the tandem method, when the photosensitive members are always kept in contact with developing rollers, the surface layers of the photosensitive members are worn off by being rubbed against the developing rollers. This shortens the life of the photosensitive members. Japanese Patent Laid-Open No. 2006-323235 proposes a technique to, by rotating a plurality of cams with a single drive source, switch photosensitive members to a developing state sequentially from upstream to downstream, and switch the photosensitive members to a non-developing state sequentially from upstream to downstream.

However, when switching the photosensitive members to a developing state sequentially from upstream to downstream as in the invention described in Japanese Patent Laid-Open No. 2006-323235, color misregistration may be enhanced. This is caused by a difference between the circumferential surface speed of the intermediate transfer belt when detecting positions of the toner patches thereon and the circumferential surface speed of the intermediate transfer belt at the time of image formation. In order to reduce the occurrence of the above color misregistration and image defects, it is necessary to control a difference in the circumferential surface speeds of the photosensitive drums and the intermediate transfer belt, as well as a difference in the circumferential surface speeds of the intermediate transfer belt and a secondary transfer roller, so as to achieve favorable image formation.

SUMMARY OF THE INVENTION

In view of the above, the feature of the present invention is to provide an image forming apparatus in which color misregistration and image defects do not easily occur due to appropriate control of a difference in the circumferential surface speeds of photosensitive drums and an intermediate transfer belt and a difference in the circumferential surface speeds of the intermediate transfer belt and a secondary transfer roller.

The present invention provides an image forming apparatus comprising the following elements. A first rotation member configured to rotate by a first drive motor. A second rotation member rotates while being in indirect contact with the first rotation member via a medium or being in direct contact with the first rotation member without the medium. A second drive motor drives the second rotation member. A first control unit controls the first drive motor to cause the first rotation member to rotate at a constant rotation frequency. A second control unit controls the second drive motor. A static friction coefficient between the first rotation member and the second rotation member is u. A contact pressure between the first rotation member and the second rotation member is F. A load torque on the second rotation member is TL. A drive torque on the second drive motor is Tm. The second control unit controls the second drive motor such that a relationship $TL-Tm \leq uF$ is satisfied when $TL \geq Tm$, and a relationship $Tm-TL < uF$ is satisfied when $TL < Tm$.

Further features of the present invention will become apparent from the following description of exemplary embodiments (with reference to the attached drawings).

DESCRIPTION OF THE EMBODIMENTS

The following describes in detail examples of embodiments of the present invention with reference to the drawings. It should be noted that the dimensions, materials, shapes, and relative arrangements of constituent elements described in the following embodiments should be changed as appropriate depending on the configuration of devices to which the present invention is applied and on various conditions. Therefore, the scope of the present invention is not limited only to those, unless specifically stated otherwise.

Embodiment 1

Figure 1:
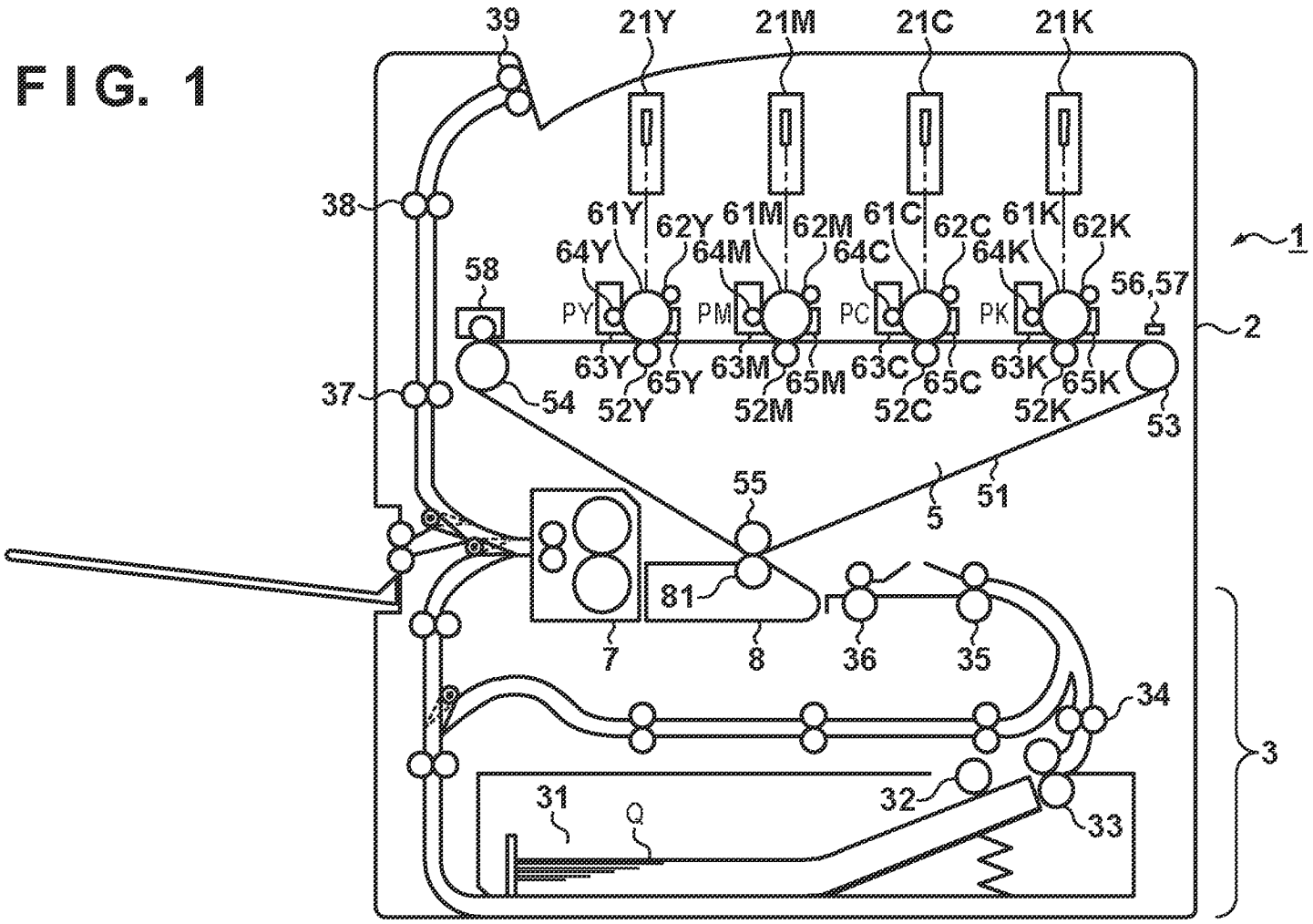
FIG. 1 is a diagram showing an image forming apparatus according to Embodiments 1, 2, 3 and 4.

A description is now given of an image forming apparatus according to Embodiment 1. FIG. 1 shows an image forming apparatus using an electrophotography method as one example of the image forming apparatus. More specifically, FIG. 1 shows a multicolor image forming apparatus using an intermediate transfer belt and four drums.

As shown in FIG. 1, an image forming apparatus 1 includes process cartridges PY, PM, PC and PK corresponding to the four colors yellow (Y), magenta (M), cyan (C) and black (K). The process cartridges PY, PM, PC and PK are detachable from a body of the image forming apparatus 1 (hereinafter referred to as a device body 2). Note that in the following description, the suffixes Y, M, C and K are omitted when explaining matters that are the same for the four colors. The device body 2 includes an intermediate transfer belt unit 5, which has an intermediate transfer belt 51 serving as an intermediate transfer member (rotation member), and a fixing unit 7. The device body 2 functions as an image forming unit that forms toner images on the circumferential surface of the intermediate transfer belt 51.

In each process cartridge P, a primary charging unit 62 is positioned facing the outer circumferential surface of a photosensitive drum 61 and uniformly charges the surface of the photosensitive drum 61. A developing unit 63 uses toner of the corresponding color (yellow, magenta, cyan or black) to develop an electrostatic latent image of the corresponding color which has been formed on the surface of the photosensitive drum 61 through exposure by a laser exposure unit 21. Deterioration of a developer can be reduced by separating the whole developing unit 63, including the developing roller 64, from the photosensitive drum 61 and stopping the rotation of the developing roller 64. In this manner, the whole developing unit 63, including the developing roller 64, comes in contact with or is separated from the photosensitive drum 61. A photosensitive member cleaner 65 removes residual toner that is attached to the surface of the photosensitive drum 61 after the primary transfer of a toner image.

A primary transfer roller 52 and the photosensitive drum 61 together hold the intermediate transfer belt 51 therebetween and constitute a primary transfer unit. The intermediate transfer belt 51 is one example of a first rotation member. The intermediate transfer belt unit 5 includes the intermediate transfer belt 51, as well as a drive roller 53, a tension roller 54 and a secondary transfer opposition roller 55 that altogether tension the intermediate transfer belt 51. Rotation of the drive roller 53 by an intermediate transfer belt motor 200 (FIG. 4) causes the intermediate transfer belt 51 to rotate. The tension roller 54 is configured to be movable along the horizontal direction of FIG. 1 in accordance with the length of the intermediate transfer belt 51. In this way, the tension of the intermediate transfer belt 51 can be maintained as substantially constant.

In the vicinity of the drive roller 53, a registration detection sensor 56 and a mark sensor 57 are positioned at both ends of the drive roller 53 in the lengthwise direction of the drive roller 53. The registration detection sensor 56 detects toner patches on the intermediate transfer belt 51. The mark sensor 57 detects position indication marks provided on the circumferential surface of the intermediate transfer belt 51. Note that the lengthwise direction is the direction of the axis of the roller and is perpendicular to the direction of conveyance of the intermediate transfer belt 51. A belt cleaner 58 is positioned in the vicinity of the tension roller 54. The belt cleaner 58 has a function of collecting residual toner on the intermediate transfer belt 51 and supplying the collected residual toner as a lubricant.

A secondary transfer roller 81 is one example of a second rotation member that rotates while being in indirect contact with the intermediate transfer belt 51 via a recording medium Q, or being in direct contact with the intermediate transfer belt 51 without the recording medium Q. The secondary transfer roller 81 and the secondary transfer opposition roller 55 are positioned so as to hold the intermediate transfer belt 51 therebetween. The secondary transfer roller 81 and the secondary transfer opposition roller 55 together constitute a secondary transfer unit. The secondary transfer roller 81 is held by a transfer conveyance unit 8.

A feeding unit 3 that feeds and conveys recording media Q to the secondary transfer unit is positioned at a lower part of the device body 2. The feeding unit 3 includes, for example, a cassette 31 in which a plurality of recording media Q are stored, a feeding roller 32 that feeds the recording media Q to a conveyance path, a pair of retarding rollers 33 for reducing a double feed, pairs of conveyance rollers 34 and 35, and a pair of registration rollers 36. Pairs of discharge rollers 37, 38 and 39 for discharging the recording media Q are positioned along a conveyance path that is downstream of the fixing unit 7.

Figure 2A:
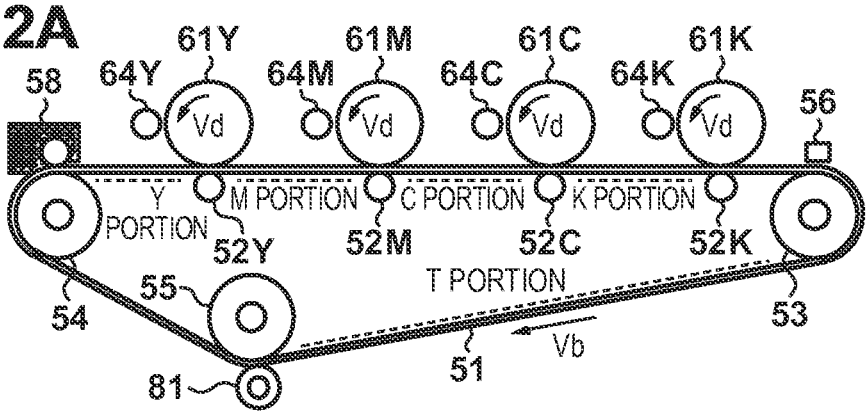
FIGS. 2A to 2D are diagrams for explaining a mechanism of the occurrence of color misregistration and image defects.
Figure 2B:
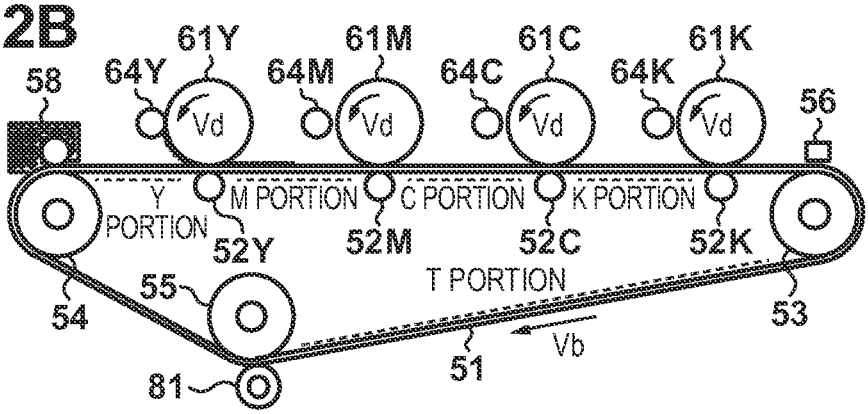
Figure 2C:
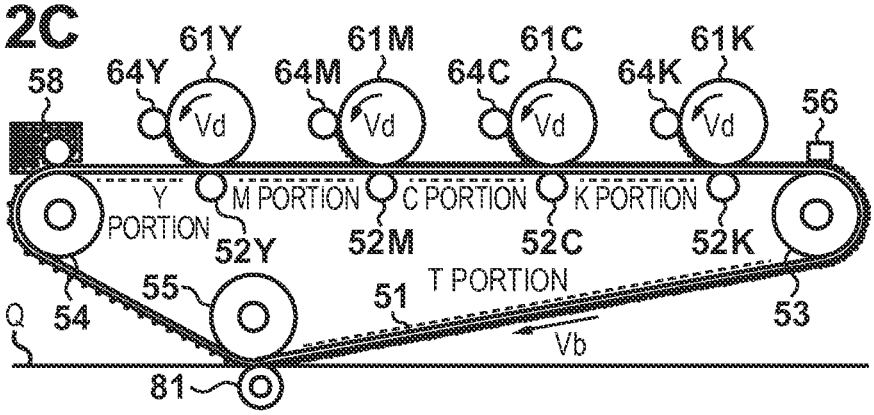
Figure 2D:
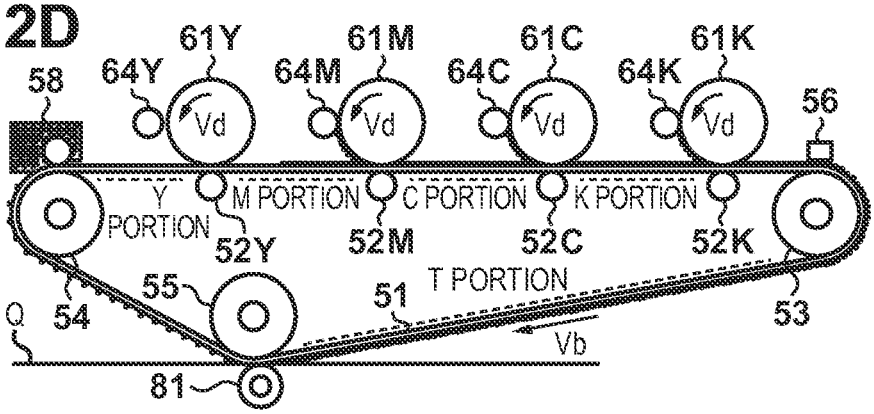

FIG. 2A shows the state where image formation is not performed for any color. FIG. 2B shows the state where a yellow image is being formed. FIG. 2C shows the state where image formation is performed for all colors. FIG. 2D shows the state where the formation of the yellow image is completed. The following describes an image forming operation for the case where the circumferential surface speed of the photosensitive drums 61 is faster than the circumferential surface speed of the intermediate transfer belt 51 with reference to FIGS. 2A to 2D.

When all the developing rollers 64 are separated from the photosensitive drums 61 as shown in FIG. 2A, if the circumferential surface speed of the photosensitive drums 61 is faster than the circumferential surface speed of the intermediate transfer belt 51, then the Y portion of the intermediate transfer belt 51 is stretched, that is to say, extended. Here, the intermediate transfer belt 51 and the photosensitive drums 61 apply pressure to nip portions so as to primary-transfer toner from the photosensitive drums 61 to the intermediate transfer belt 51. The Y portion of the intermediate transfer belt 51 is extended due to the yellow photosensitive drum 61Y pulling the intermediate transfer belt 51.

In this state, image formation is started. As shown in FIG. 2B, the yellow developing roller 64Y comes in contact with the yellow photosensitive drum 61Y, and fogging toner arrives at a nip portion formed by the yellow photosensitive drum 61Y and the intermediate transfer belt 51. When the force of dynamic friction between the yellow photosensitive drum 61Y and the intermediate transfer belt 51 is reduced by the toner, a slip occurs between the yellow photosensitive drum 61Y and the intermediate transfer belt 51. As a result, the extended Y portion of the intermediate transfer belt 51 starts to compress. After that, a similar phenomenon occurs between the magenta photosensitive drum 61M and the intermediate transfer belt 51, and therefore the Y portion and the M portion of the intermediate transfer belt 51 are extended. A similar phenomenon occurs also between the cyan photosensitive drum 61C and the intermediate transfer belt 51, and between the black photosensitive drum 61K and the intermediate transfer belt 51. In other words, by the time all the developing rollers 64 come in contact with the photosensitive drums 61, extension and contraction of the intermediate transfer belt 51 occur several times.

When all the developing rollers 64 are in contact with the photosensitive drums 61 as shown in FIG. 2C, fogging toner exists at all the nip portions formed by the intermediate transfer belt 51 and the photosensitive drums 61. Due to the fogging toner, a slip always occurs between the intermediate transfer belt 51 and all the photosensitive drums 61. Because of the occurrence of the slip, the intermediate transfer belt 51 does not extend or contract even if the circumferential surface speed of the photosensitive drums 61 is faster than the circumferential surface speed of the intermediate transfer belt 51.

When the image formation is completed, the yellow developing roller 64Y is separated from the yellow photosensitive drum 61Y, and a portion with no fogging toner arrives at the nip portion formed by the yellow photosensitive drum 61Y and the intermediate transfer belt 51, as shown in FIG. 2D. As a result, the force of dynamic friction between the yellow photosensitive drum 61Y and the intermediate transfer belt 51 increases. Furthermore, the yellow photosensitive drum 61Y and the intermediate transfer belt 51 start tacking each other, thus stretching the Y portion of the intermediate transfer belt 51. On the other hand, the M portion, the C portion and the K portion become loose. After that, a similar phenomenon occurs also between the magenta photosensitive drum 61M and the intermediate transfer belt 51, between the cyan photosensitive drum 61C and the intermediate transfer belt 51, and between the black photosensitive drum 61K and the intermediate transfer belt 51. In other words, by the time all the developing rollers 64 are separated from the photosensitive drums 61, extension and contraction of the intermediate transfer belt 51 occur several times. Extension and contraction of the intermediate transfer belt 51 affect a transfer position of a toner image of each color on the intermediate transfer belt 51, and show up in a multicolor image as color misregistration.

As set forth above, there are three states in image formation: a first state where the developing rollers 64 come in contact with the photosensitive drums 61 in sequence, a second state where all the developing rollers 64 are in contact with the photosensitive drums 61, and a third state where the developing rollers 64 are separated from the photosensitive drums 61 in sequence. Correction of color misregistration is a process in which toner patches of different colors are formed on the intermediate transfer belt 51, the positions of the toner patches are detected using the registration detection sensor 56, and the timings at which toner images of different colors are applied to the intermediate transfer belt 51 are changed in accordance with the result of detection. In general, the correction of color misregistration is executed in the second state where all the developing rollers 64 are in contact with the photosensitive drums 61. Therefore, it is not possible to correct color misregistration caused by extension and contraction of the intermediate transfer belt 51 that occur in the first state where the developing rollers 64 come in contact with the photosensitive drums 61 in sequence, and in the third state where the developing rollers 64 are separated from the photosensitive drums 61 in sequence. Furthermore, the amount of extension and contraction fluctuates in accordance with a difference in the circumferential surface speeds of the intermediate transfer belt 51 and the photosensitive drums 61, friction coefficients, and the environment. Fluctuations in the amount of extension and contraction cause fluctuations in the amount of color misregistration.

Conversely, when the circumferential surface speed of the photosensitive drums 61 is slower than the circumferential surface speed of the intermediate transfer belt 51, color misregistration occurs due to a reverse mechanism.

A description is now given of the case where the circumferential surface speed of the secondary transfer roller 81 is faster than the circumferential surface speed of the intermediate transfer belt 51. When no toner exists at a nip portion formed by the secondary transfer roller 81 and the intermediate transfer belt 51 as shown in FIG. 2A, the T portion of the intermediate transfer belt 51 is stretched, that is to say, extended. This is because pressure is applied to the nip portion formed by the secondary transfer roller 81 and the intermediate transfer belt 51 so as to secondary-transfer toner from the intermediate transfer belt 51 to a recording medium Q. Hence, the T portion of the intermediate transfer belt 51 is extended by being pulled by the secondary transfer roller 81.

In this state, image formation is started. As shown in FIG. 2C, toner images on the intermediate transfer belt 51 and the recording medium Q arrive at the nip portion formed by the secondary transfer roller 81 and the intermediate transfer belt 51. As the force of dynamic friction between the secondary transfer roller 81 and the recording medium Q is large, the recording medium Q is conveyed by the circumferential surface speed of the secondary transfer roller 81. However, because no toner image exists at the nip portion between the recording medium Q and the intermediate transfer belt 51, the force of dynamic friction between the recording medium Q and the intermediate transfer belt 51 is reduced, and a slip occurs between the recording medium Q and the intermediate transfer belt 51. As a result, the T portion of the intermediate transfer belt 51 starts to contract. This slip rubs the toner images on the recording medium Q, thereby causing the occurrence of image defects.

Regarding this phenomenon, when the circumferential surface speed of the secondary transfer roller 81 is slower than the circumferential surface speed of the intermediate transfer belt 51, image defects occur due to a reverse mechanism as with the relationship between the intermediate transfer belt 51 and the photosensitive drums 61.

In order to deter the occurrence of the above color misregistration and image defects, it is necessary to control differences in the circumferential surface speeds of the photosensitive drums 61, the intermediate transfer belt 51 and the secondary transfer roller 81 so as to achieve favorable image formation.

Figure 3:
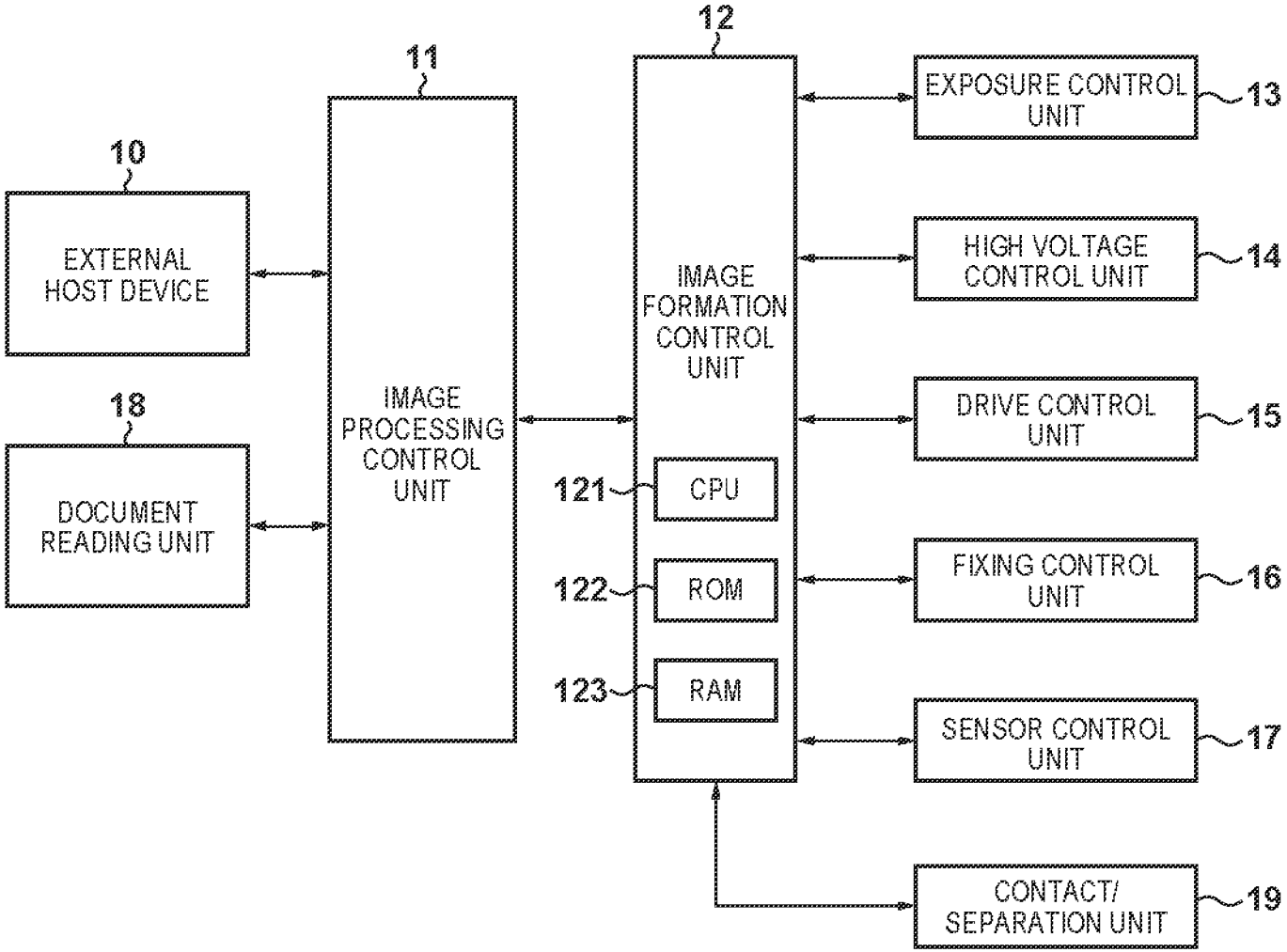
FIG. 3 is a block diagram showing a configuration for controlling the image forming apparatus according to Embodiments 1, 2, 3 and 4.

A description is now given of a configuration for controlling the image forming apparatus with reference to FIG. 3. The device body 2 receives a job from an external host device 10, such as a personal computer, that is connected to and can communicate with the device body 2. The device body 2 also receives an RGB image signal from a document reading unit 18 provided therein.

An image processing control unit 11 converts the input RGB image signal into a CMYK signal, generates an exposure signal by applying tone correction and density correction, and supplies the generated exposure signal to the laser exposure unit 21. An image formation control unit 12 controls the entirety of the image forming operation described below. The image formation control unit 12 controls the device body 2 also when correcting the image forming operation using the registration detection sensor 56 and the mark sensor 57.

In the image formation control unit 12, a CPU 121 executes various types of processing of the image formation control unit 12. A ROM 122 stores therein programs executed by the CPU 121, control data, and the like. A RAM 123 stores therein various types of data when the CPU 121 executes control processing.

In accordance with instructions from the CPU 121, an exposure control unit 13 drives the laser exposure unit 21, drives a scanner motor that rotates a rotating polygon mirror, and corrects the amount of laser light. In accordance with instructions from the CPU 121, a high voltage control unit 14 generates a charge bias for the photosensitive drums 61, a developing bias, a primary transfer bias for the intermediate transfer belt 51, a secondary transfer bias for the recording media Q, and a belt cleaning bias for the belt cleaner. In accordance with instructions from the CPU 121, a drive control unit 15 drives motors for an image forming system, namely the photosensitive drums 61, the developing rollers 64 and the intermediate transfer belt 51, as well as conveyance motors for conveying the recording media Q. In accordance with instructions from the CPU 121, a fixing control unit 16 adjusts the temperature of the fixing unit 7. A sensor control unit 17 detects toner patches on the intermediate transfer belt 51 using the registration detection sensor 56, and detects position indication marks provided on the intermediate transfer belt 51 using the mark sensor 57.

A contact/separation unit 19 has a function of causing the secondary transfer roller 81 and the intermediate transfer belt 51 to come in contact with each other and to be separated from each other in accordance with instructions from the CPU 121. The contact/separation unit 19 includes, for example, a secondary transfer separation motor and eccentric cams, and moves the secondary transfer roller 81 up and down by rotating the secondary transfer separation motor in a predetermined direction. This causes the secondary transfer roller 81 and the intermediate transfer belt 51 to come in contact with each other and to be separated from each other.

Figure 4:
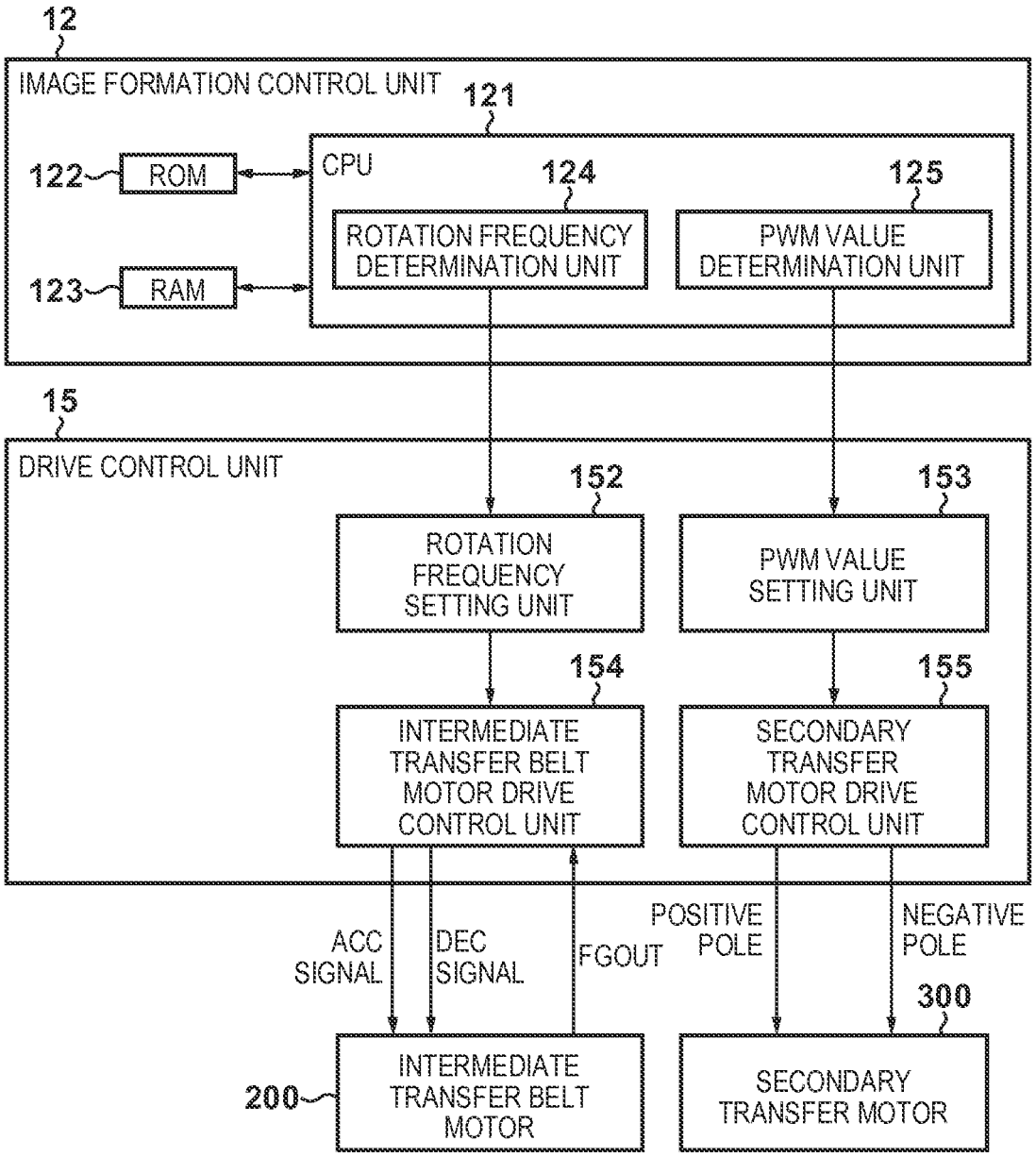
FIG. 4 is a block diagram showing a drive control unit according to Embodiment 1.

FIG. 4 shows the detail of the drive control unit 15. Although the drive control unit 15 controls a large number of objects, the following describes the matters that relate to control for driving an intermediate transfer belt motor 200 and a secondary transfer motor 300 associated with the present invention. Note that a brushless DC motor, which is a synchronous motor, is used as the intermediate transfer belt motor 200 in the present embodiment. On the other hand, a brushed DC motor, which is an asynchronous motor, is used as the secondary transfer motor 300.

A description is now given of control for driving the intermediate transfer belt motor 200. The intermediate transfer belt motor 200 is one example of a first drive motor that drives the intermediate transfer belt 51. A rotation frequency determination unit 124 in the CPU 121 determines a rotation frequency corresponding to the print setting and sets the determined rotation frequency to a rotation frequency setting unit 152. For example, as the process speed varies between types of recording media, the ROM 122 stores therein a function, a table or a program that shows a relationship between the types of recording media and rotation frequencies in advance. With reference to the table or the like, the rotation frequency determination unit 124 determines the rotation frequency corresponding to the type of the recording medium included in the print setting.

An intermediate transfer belt motor drive control unit 154 is one example of a first control unit that controls the intermediate transfer belt motor 200 to rotate the intermediate transfer belt 51 at a constant rotation frequency. The intermediate transfer belt motor drive control unit 154 controls the intermediate transfer belt motor 200 based on a predetermined rotation frequency set to the rotation frequency setting unit 152 and FGOUT, which is a speed signal from the intermediate transfer belt motor 200. More specifically, the intermediate transfer belt motor drive control unit 154 controls the intermediate transfer belt motor 200 using an ACC signal and a DEC signal, which are respectively an acceleration signal and a deceleration signal, so that the rotation speed (rotation frequency) of the intermediate transfer belt motor 200 matches the set speed.

A description is now given of the secondary transfer motor 300. The secondary transfer motor 300 is one example of a second drive motor that drives the secondary transfer roller 81. A PWM value determination unit 125 in the CPU 121 determines a PWM value corresponding to the print setting and sets the determined PWM value to a PWM value setting unit 153. The relationship between print settings and PWM values is stored in the ROM 122. Therefore, the PWM value determination unit 125 determines the PWM value corresponding to the print setting based on the stored relationship.

Figure 5:
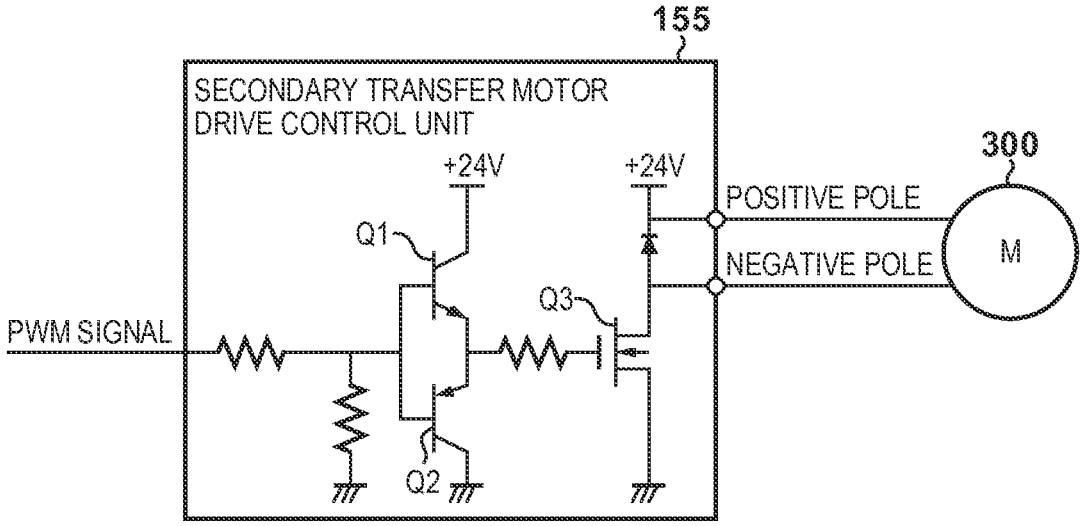
FIG. 5 is a block diagram showing a secondary transfer motor drive control unit according to Embodiment 1.

A secondary transfer motor drive control unit 155 is one example of a second control unit that controls the secondary transfer motor 300. The secondary transfer motor drive control unit 155 outputs a PWM signal corresponding to the PWM value set to the PWM value setting unit 153. Below, driving of the secondary transfer motor 300 is described in more detail with reference to FIG. 5. The PWM signal output from the PWM value setting unit 153 is amplified to +24 V by transistors Q1 and Q2. The amount of power supplied to the secondary transfer motor 300 is controlled by the amplified PWM signal turning ON/OFF a field effect transistor (FET) Q3. That is to say, the larger the PWM value (the larger the ON duty of Q3), the larger the amount of power supplied to the secondary transfer motor 300. Conversely, the smaller the PWM value, the smaller the amount of power supplied to the secondary transfer motor 300. It should be noted that when the frequency of the PWM signal is too low, the rotation of and the torque on the secondary transfer motor 300 become uneven. Conversely, when the frequency of the PWM signal is too high, the noise increases. For this reason, in many cases, the frequency of the PWM signal is generally set to tens of kHz or so.

Figure 6:
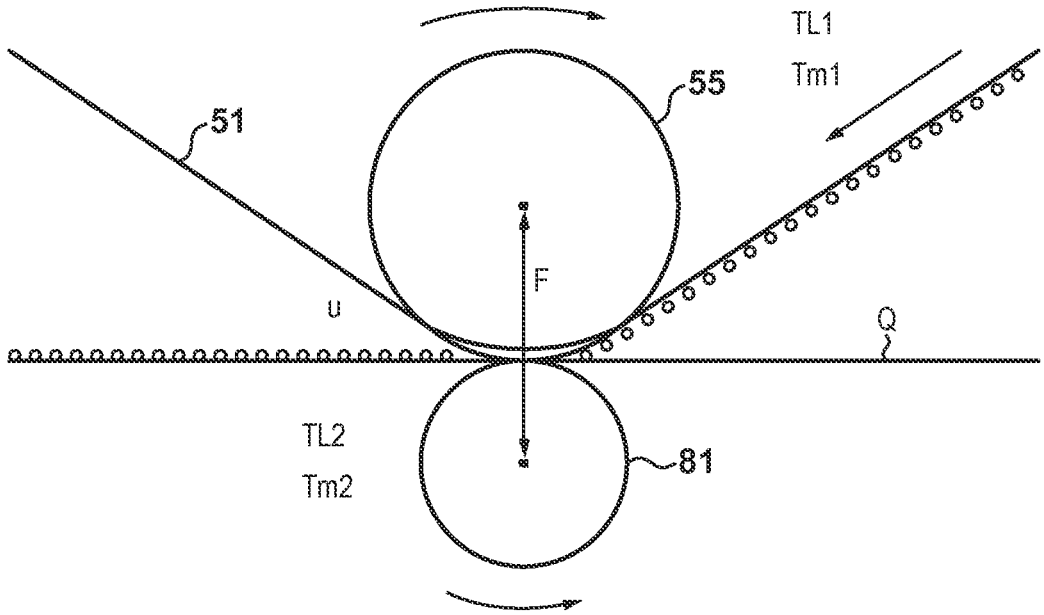
FIG. 6 is a diagram for explaining torques on an intermediate transfer belt and a secondary transfer roller and the force of friction therebetween in Embodiment 1.

FIG. 6 shows a relationship among the load torque, the drive torque and the force of friction associated with the secondary transfer unit. TL1 is the load torque on the intermediate transfer belt 51. Tm1 is the drive torque that the intermediate transfer belt motor 200 applies to the intermediate transfer belt 51. TL2 is the load torque on the secondary transfer roller 81. Tm2 is the drive torque that the secondary transfer motor 300 applies to the secondary transfer roller 81. It is assumed here that the torque Tm1 applied to the intermediate transfer belt 51 is sufficiently large with respect to the load torque TL1 on the intermediate transfer belt 51 and satisfies the relationship Tm1>TL1+uF. Here, u denotes a static friction coefficient between the secondary transfer roller 81 and the intermediate transfer belt 51 when a recording medium Q and toner exist between the secondary transfer roller 81 and the intermediate transfer belt 51. For example, the value of the static friction coefficient u is about 0.15. F denotes a contact pressure between the secondary transfer opposition roller 55, which is one example of a first rotation member, and the secondary transfer roller 81. That is to say, the force of friction L between the secondary transfer roller 81 and the intermediate transfer belt 51 can be expressed as uF. It means that the secondary transfer roller 81 is subjected to a torque of L=uF from the intermediate transfer belt 51.

Figure 7:
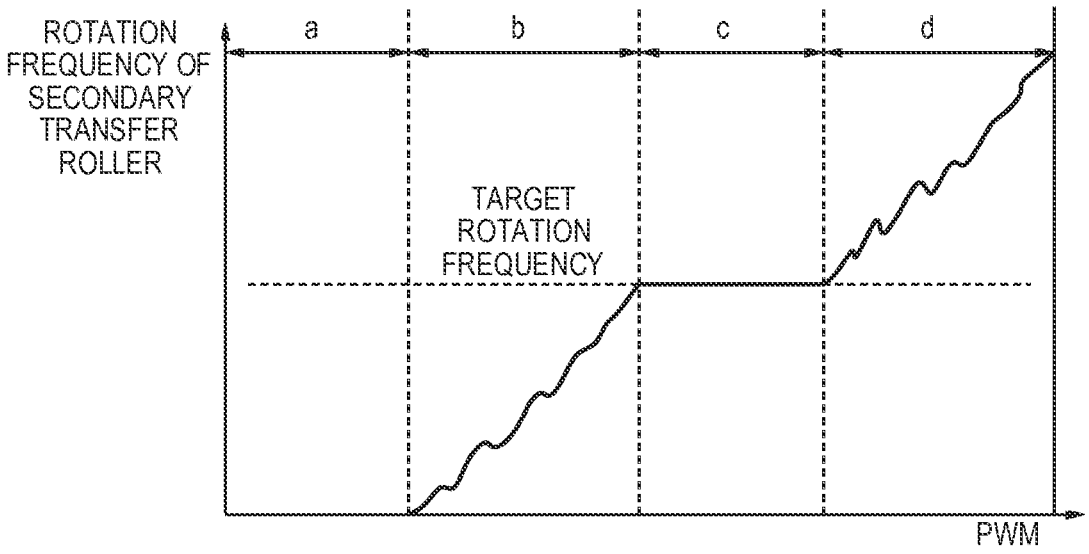
FIG. 7 is a diagram showing a relationship between the PWM value and the rotation frequency of the secondary transfer roller in Embodiment 1.

FIG. 7 shows the rotation frequency of the secondary transfer roller 81 obtained while changing the PWM value set to the PWM value setting unit 153 in the state where the intermediate transfer belt 51 is driven at a constant speed.

With the PWM values of section a, the drive torque Tm2 is extremely small compared to the load torque TL2 on the secondary transfer roller 81, and therefore the secondary transfer roller 81 does not rotate at all. In this case, the drive torque Tm2 on the secondary transfer roller 81, the load torque TL2 on the secondary transfer roller 81, and the force of friction uF satisfy the following relationship.

$$TL2-Tm2>>uF$$

This indicates the occurrence of a slip between the secondary transfer roller 81 and the intermediate transfer belt 51.

With the PWM values of section b, the drive torque Tm2 is smaller than the load torque TL2 on the secondary transfer roller 81. In section b, although the secondary transfer roller 81 is rotating, the rotation frequency thereof is below the target rotation frequency. In this case, the drive torque Tm2 on the secondary transfer roller 81, the load torque TL2 on the secondary transfer roller 81, and the force of friction uF satisfy the following relationship.

$$TL2-Tm2>uF$$

This indicates the occurrence of a slip between the secondary transfer roller 81 and the intermediate transfer belt 51.

With the PWM values of section c, the drive torque Tm2 applied to the load torque TL2 on the secondary transfer roller 81 is appropriate, and therefore the secondary transfer roller 81 rotates at the target rotation frequency. In this case, the drive torque Tm2 on the secondary transfer roller 81, the load torque TL2 on the secondary transfer roller 81, and the force of friction uF satisfy the following relationship.

$$TL2-Tm2\leq uF \text{ for the case where } TL2\geq Tm2$$

$$Tm2-TL2<uF \text{ for the case where } TL2<Tm2$$

This indicates that the secondary transfer roller 81 is acting as the follower of the intermediate transfer belt 51.

With the PWM values of section d, the drive torque Tm2 is larger than the load torque TL2 on the secondary transfer roller 81. In section d, although the secondary transfer roller 81 is rotating, the rotation frequency thereof exceeds the target rotation frequency. In this case, the drive torque Tm2, the load torque TL2 on the secondary transfer roller 81, and the force of friction uF satisfy the following relationship.

$$Tm2-TL2>uF$$

This indicates the occurrence of a slip between the secondary transfer roller 81 and the intermediate transfer belt 51.

Therefore, the secondary transfer roller 81 acts as the follower of the intermediate transfer belt 51 when the drive torque Tm2 applied to the secondary transfer roller 81 is set such that the relationship TL2−Tm2≤uF is satisfied for the case where TL2≥Tm2, and the relationship Tm2−TL2<uF is satisfied for the case where TL2<Tm2. These relationships are referred to as a follower condition. The drive torque Tm2 can be set to an appropriate value by setting the PWM value. This is because the PWM value is one of the parameters that determine the torque on the secondary transfer motor 300. By thus driving the secondary transfer motor 300 such that the follower condition is satisfied, the difference in the circumferential surface speeds of the secondary transfer roller 81 and the intermediate transfer belt 51 can be appropriately controlled, and therefore color misregistration and image defects can be alleviated.

Although the above has described a control method based on the PWM value as one example of a control method for the secondary transfer motor 300, similar effects can be achieved by controlling voltage applied to the secondary transfer motor 300. Furthermore, although the above has described the relationship between the secondary transfer roller 81 and the intermediate transfer belt 51, this is also true of the relationship between the secondary transfer belt and the intermediate transfer belt as well as the relationship between the photosensitive drums 61 and the intermediate transfer belt 51.

Embodiment 2

Embodiment 2 describes a specific method for setting the drive torque Tm2 applied to the secondary transfer roller 81, namely a method for setting the PWM value, with which the relationship TL2−Tm2 uF is satisfied when TL2≥Tm2 and the relationship Tm2−TL2<uF is satisfied when TL2<Tm2. In particular, in Embodiment 2, the CPU 121 drives the secondary transfer motor 300 while the intermediate transfer belt 51 and the secondary transfer roller 81 are separated from each other. The CPU 121 stores, in the RAM 123, the input voltage applied to the secondary transfer motor 300 or the PWM value set when the rotation frequency of the secondary transfer motor 300 has reached a predetermined value, and reads out and uses the stored input voltage or PWM value at the time of printing.

Figure 8:
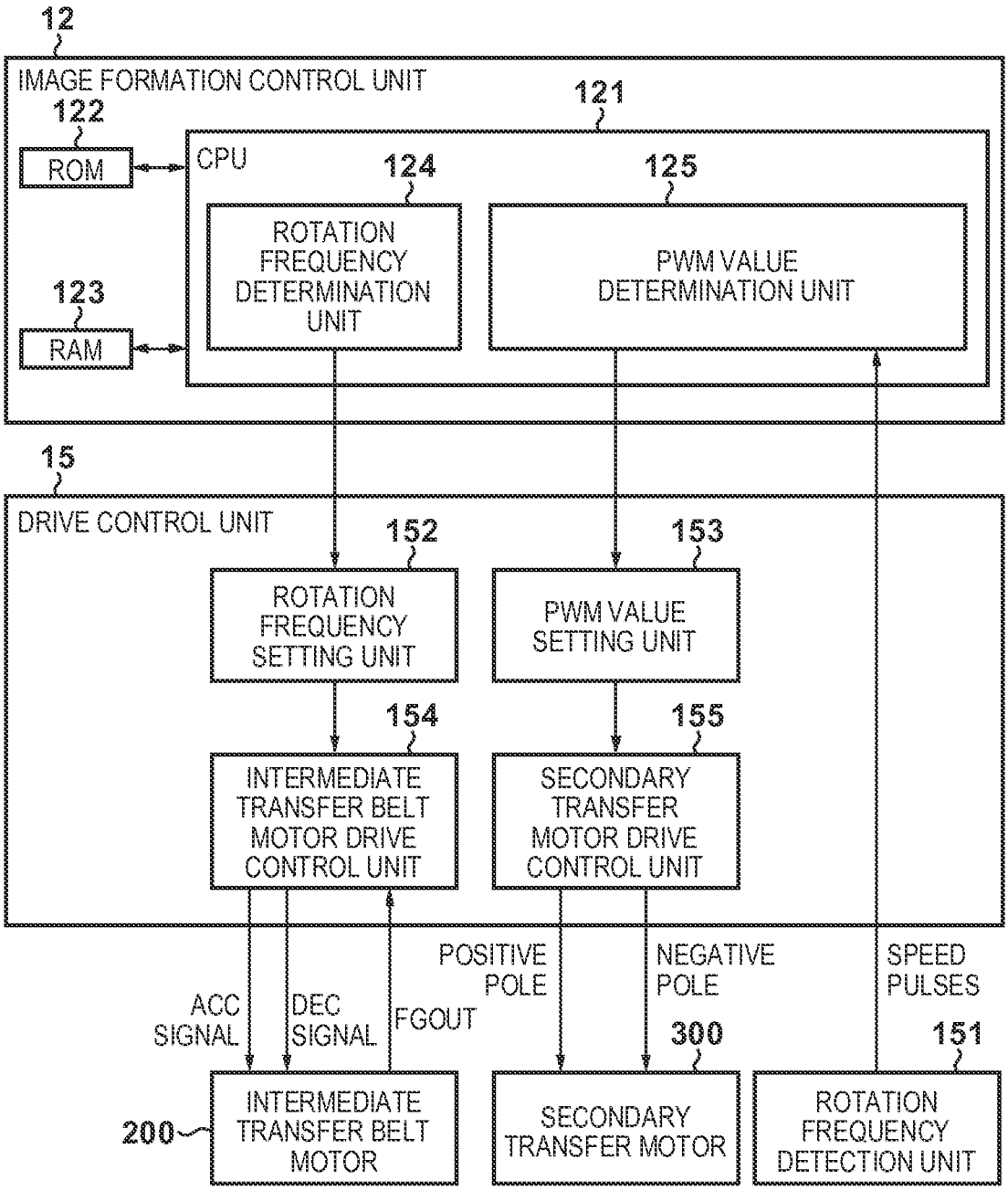
FIG. 8 is a block diagram showing a drive control unit that involves detection of rotation of the secondary transfer roller according to Embodiments 2, 3 and 4.

FIG. 8 shows the detail of the drive control unit 15 according to Embodiment 2. Many parts are the same as in the drive control unit 15 according to Embodiment 1. Below, a description thereof is omitted and only the different parts will be described. A rotation frequency detection unit 151 has a function of detecting the rotation frequency of the secondary transfer roller 81. The rotation frequency detection unit 151 can be constituted by, for example, a photosensor and a code wheel provided with slits. The rotation frequency detection unit 151 is arranged on the axis of the secondary transfer roller 81 and outputs speed pulses corresponding to the rotation frequency of the secondary transfer roller 81. When the rotation frequency of the secondary transfer roller 81 is high, the frequency of the speed pulses is high. Conversely, when the rotation frequency of the secondary transfer roller 81 is low, the frequency of the speed pulses is low. The speed pulses are input to the PWM value determination unit 125 in the CPU 121. Although the rotation frequency detection unit 151 has been described above as being arranged on the axis of the secondary transfer roller 81, it may instead be arranged on the axis of the secondary transfer motor 300 or on the axis of a gear that delivers a driving force to the secondary transfer roller 81. This is because data proportional to the rotation frequency of the secondary transfer roller 81 can be measured at any one of the above locations. The rotation frequency detection unit 151 outputs the speed pulses to the PWM value determination unit 125.

Figure 9B:
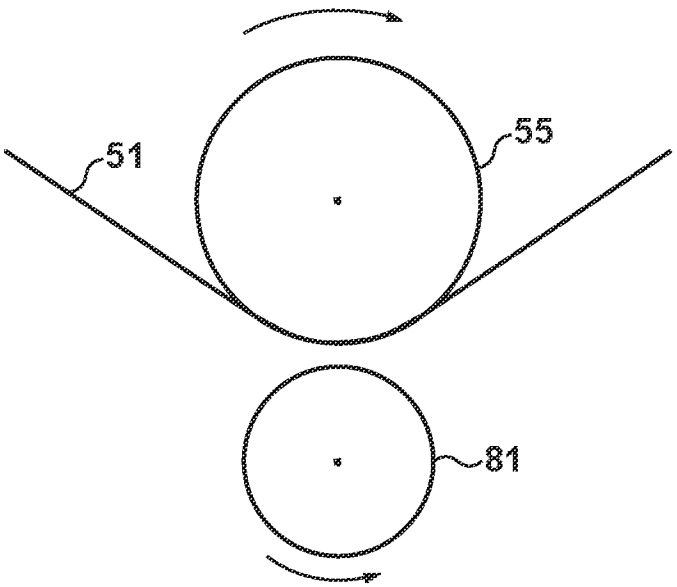
FIGS. 9A and 9B are diagrams for explaining contact between and separation of the intermediate transfer belt and the secondary transfer roller in Embodiment 2.
Figure 9A:
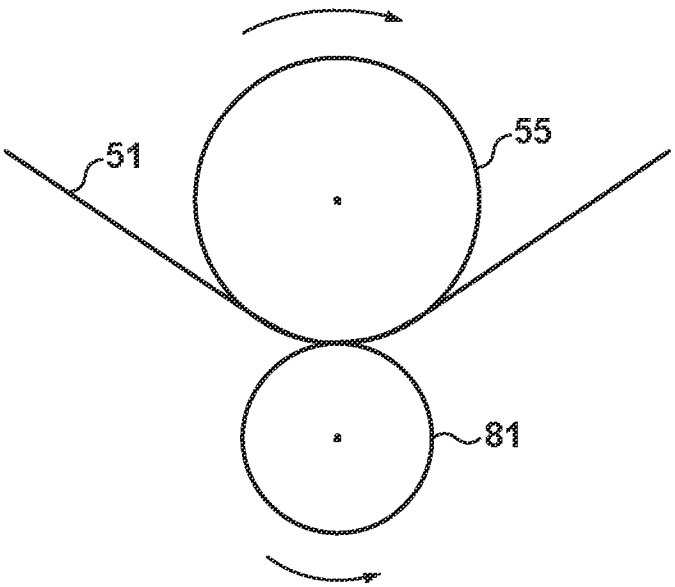

A description is now given of contact between and separation of the secondary transfer roller 81 and the intermediate transfer belt 51 with reference to FIGS. 9A and 9B. The up/down movement of the secondary transfer roller 81 causes the secondary transfer roller 81 and the intermediate transfer belt 51 to come in contact with each other and to be separated from each other. The up/down movement of the secondary transfer roller 81 can be realized by, for example, the secondary transfer separation motor and eccentric cams.

FIG. 9A shows the state where the secondary transfer roller 81 and the intermediate transfer belt 51 are in contact with each other. The secondary transfer roller 81 and the intermediate transfer belt 51 are in this state at the time of printing. FIG. 9B shows the state where the secondary transfer roller 81 and the intermediate transfer belt 51 are separated from each other. The secondary transfer roller 81 and the intermediate transfer belt 51 are in this state when the power of the image forming apparatus 1 is OFF and during standby for the printing. In this way, when the secondary transfer roller 81 and the intermediate transfer belt 51 are not driven, deformation thereof can be alleviated.

Figure 10:
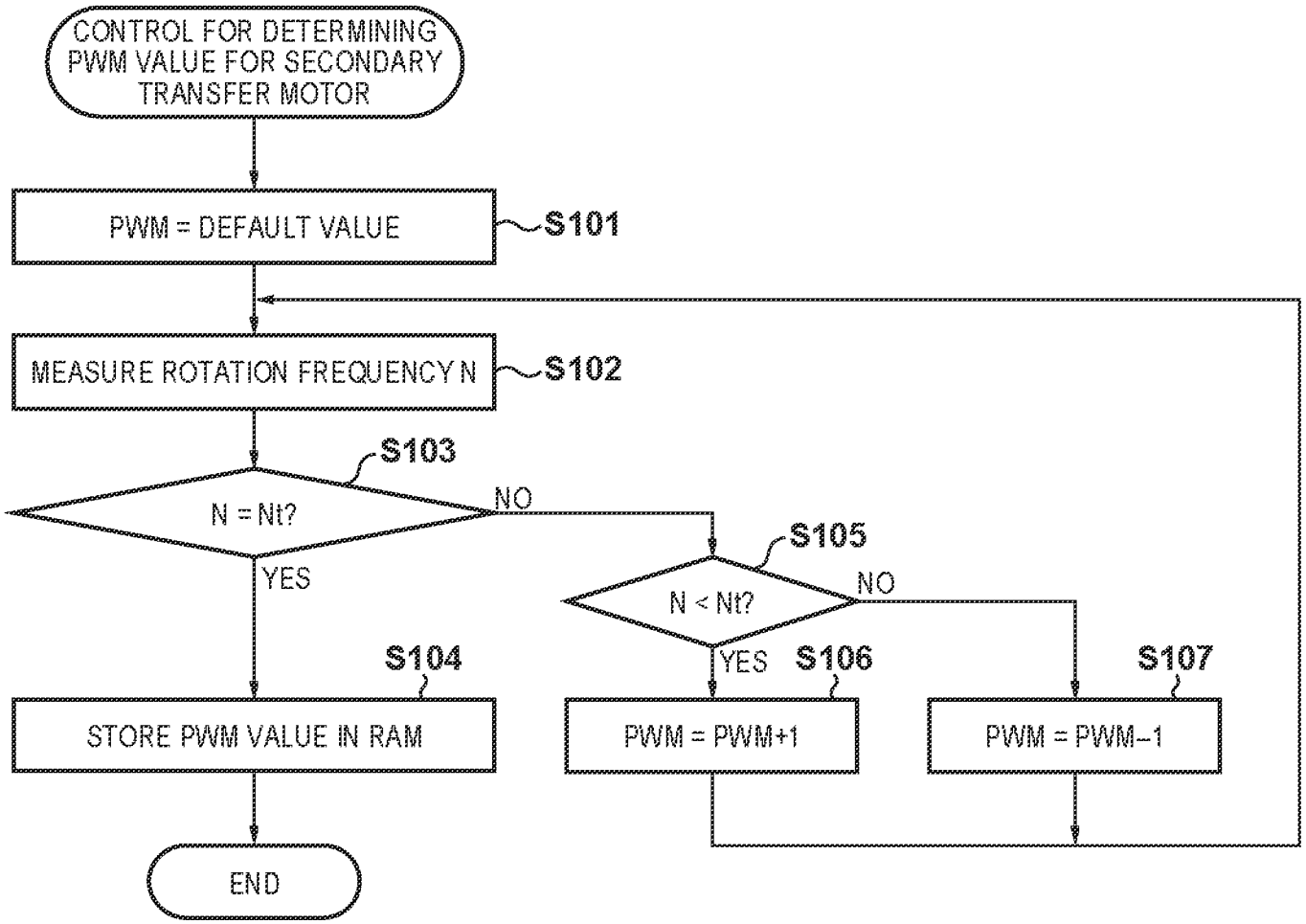
FIG. 10 is a flowchart for explaining control according to Embodiment 2.

A description is now given of a method for setting the PWM value that satisfies the follower condition with reference to FIG. 10. It is assumed here that the intermediate transfer belt 51 and the secondary transfer roller 81 are separated from each other. Note that the flowchart of FIG. 10 shows processing executed by the CPU 121.

In S101, the PWM value determination unit 125 in the CPU 121 sets a default value to the PWM value setting unit 153. Here, a nominal design value is used as the default value.

In S102, the PWM value determination unit 125 measures the rotation frequency N of the secondary transfer roller 81 by counting the speed pulses output from the rotation frequency detection unit 151.

In S103, the PWM value determination unit 125 compares the measured rotation frequency N with the rotation frequency Nt of the nominal design value to determine whether or not they are equal to each other. When N=Nt, the processing moves to S104.

In S104, the PWM value determination unit 125 stores the PWM value at that point in the RAM 123 and ends the present control. On the other hand, when the result of determination is N≠Nt in S103, the processing moves to S105.

In S105, the PWM value determination unit 125 determines whether or not the rotation frequency N is smaller than the nominal design value Nt. When N<Nt, the processing moves to S106.

The PWM value determination unit 125 increments the PWM value by a predetermined value in S106, and then repeats the processing again from S102. On the other hand, when the result of determination is N>Nt in S105, the processing moves to S107.

The PWM value determination unit 125 decrements the PWM value by a predetermined value in S107, and then repeats the processing again from S102.

Although the nominal design value is used as the default value for the PWM value in S101, a previous PWM value or the like may instead be used as the default value for the PWM value. Furthermore, when the rotation frequency N of the secondary transfer roller 81 is compared with the rotation frequency Nt of the nominal design value in S103, the rotation frequency Nt may have a predetermined range or may be offset by a predetermined value so as to achieve the best image. In the former case, the processing moves to S104 when Nt−Δ≤N≤Nt+Δ. In the latter case, the processing moves to S104 when Nt−Δ=N.

Provided that the power supplied to the secondary transfer motor 300 is P and the efficiency of the secondary transfer motor is η, the relationship P×η=Nt×Tm2 holds. Furthermore, as the secondary transfer roller 81 with the load torque TL2 is driven at a predetermined rotation frequency, the relationship TL2=Tm2 holds.

The following describes the relationship between TL2 and Tm2 when the secondary transfer roller 81 and the intermediate transfer belt 51 are in contact with each other. When there is no difference in the circumferential surface speeds of the secondary transfer roller 81 and the intermediate transfer belt 51, it suffices for the secondary transfer motor 300 to drive only the load for the secondary transfer roller 81. Accordingly, the above relationship TL2=Tm2 holds, and the relationship TL2−Tm2≤uF is satisfied for certain.

The following describes the case where there is a difference in the circumferential surface speeds of the secondary transfer roller 81 and the intermediate transfer belt 51. Generally speaking, a difference in the circumferential surface speeds of the secondary transfer roller 81 and the intermediate transfer belt 51 occurs as a result of variations in diameters of driven rollers and differences in coefficients of expansion. Normally, the difference in the circumferential surface speeds is approximately ±0.5%. It is assumed here that the circumferential surface speed of the secondary transfer roller 81 is slower than the circumferential surface speed of the intermediate transfer belt 51 by 0.5%. It is also assumed here that, when there is no difference in the circumferential surface speeds of the secondary transfer roller 81 and the intermediate transfer belt 51, the rotation frequency of the secondary transfer roller 81 is Nr. The rotation frequency Nt of the nominal design value shown in FIG. 10 can be expressed as Nt=Nr×0.995. By substituting this expression into P×η=Nt×Tm2, the following can be obtained: P×η=(0.995×Nr)×Tm2. In this state, when the secondary transfer roller 81 and the intermediate transfer belt 51 come in contact with each other, the secondary transfer roller 81 starts to rotate at the rotation frequency Nr. When the secondary transfer motor 300 is driven in accordance with the PWM value determined through the control for determining the PWM value for driving the secondary transfer motor shown in FIG. 10, the relationship P×η=Nr×(0.995×Tm2) holds. That is to say, although the efficiency η changes when the rotation frequency Nr changes, should the change in the rotation frequency Nr be extremely small and the change in the efficiency η be accordingly minute, the torque Tm applied to the secondary transfer roller 81 is reduced. By substituting this expression into the expression of the follower condition, the following can be obtained.

$$TL2-(0.995\times Tm2)\leq uF$$

As TL2=Tm2, the following relationship holds.

$$TL2-(0.995\times TL2)\leq uF$$

That is to say, it suffices to satisfy the following relationship.

$$0.005\times TL2\leq uF$$

For example, when a recording medium Q and toner exist between the intermediate transfer belt 51 and the secondary transfer roller 81 made of polyimide material at the time of printing, the friction coefficient u between the intermediate transfer belt 51 and the secondary transfer roller 81 is approximately 0.15. Furthermore, the contact pressure F between the secondary transfer opposition roller 55 and the secondary transfer roller 81 is approximately 0.4 Nm. Moreover, the load torque TL2 on the secondary transfer roller 81 is approximately 0.15 Nm even when a cleaning member is provided. Therefore, the follower condition is satisfied.

As has been described above, the secondary transfer motor 300 is driven while the secondary transfer roller 81 and the intermediate transfer belt 51 are separated from each other, and the PWM value is changed such that the rotation frequency N of the secondary transfer roller 81 equals the nominal design value Nt. This enables obtainment of the PWM value that satisfies the follower condition. In Embodiment 2 also, an applied voltage control method may be used as the method for controlling the secondary transfer motor 300. As with Embodiment 1, Embodiment 2 is applicable to the relationship between the secondary transfer belt and the intermediate transfer belt as well as to the relationship between the photosensitive drums 61 and the intermediate transfer belt 51.

Embodiment 3

Unlike Embodiment 2, Embodiment 3 describes a method for setting the drive torque Tm2 (PWM value) that satisfies the follower condition by detecting a change in the speed of the secondary transfer roller 81 while supplying toner as a lubricant to the point of contact (nip portion) between the secondary transfer roller 81 and the intermediate transfer belt 51. Accordingly, in Embodiment 3, the rotation frequency detection unit 151 detects the rotation frequency of the secondary transfer motor 300 when toner images pass through the nip portion. Furthermore, the feature of Embodiment 3 is such that the CPU 121 stores, in the RAM 123, the input voltage applied to the secondary transfer motor 300 or the PWM value set when the rotation frequency of the secondary transfer motor 300 has reached a predetermined value, and uses the stored input voltage or PWM value at the time of printing.

Basic configurations of the image forming apparatus 1 and the rotation frequency detection unit 151 for the secondary transfer roller 81 are the same as in Embodiments 1 and 2, and therefore a description thereof is omitted below. Accordingly, Embodiment 3 describes supply of toner to the nip portion between the secondary transfer roller 81 and the intermediate transfer belt 51.

As the formation of toner images on the photosensitive drums 61 and the primary transfer of the toner images to the intermediate transfer belt 51 are the same as in the general image forming method described in Embodiment 1, a description thereof is omitted below. When no toner image exists at the nip portion between the secondary transfer roller 81 and the intermediate transfer belt 51, the force of friction u between the secondary transfer roller 81 and the intermediate transfer belt 51 increases. Therefore, when there is a difference in the circumferential surface speeds of the secondary transfer roller 81 and the intermediate transfer belt 51, the secondary transfer roller 81 places a large load on the intermediate transfer belt 51. For example, assume that toner is supplied from the black process cartridge PK. The black toner is conveyed on the intermediate transfer belt 51 and arrives at the nip portion between the intermediate transfer belt 51 and the secondary transfer roller 81. When the toner image exists at the nip portion between the secondary transfer roller 81 and the intermediate transfer belt 51, the toner image acts as a lubricant and therefore the force of friction u between the secondary transfer roller 81 and the intermediate transfer belt 51 is reduced. When the drive torque Tm2 applied to the secondary transfer roller 81 differs from the load torque TL2, a slip occurs between the intermediate transfer belt 51 and the secondary transfer roller 81. The occurrence of the slip causes a fluctuation in the speed of the secondary transfer roller 81. Therefore, it suffices for the PWM value determination unit 125 to set the drive torque Tm2 applied to the secondary transfer roller 81, namely the PWM value, to the PWM value setting unit 153 such that a fluctuation in the speed of the secondary transfer roller 81 stays at or below a predetermined value in a shift from the state where no toner image exists at the nip portion to the state where the toner image exists at the nip portion.

Note that when the drive torque Tm applied to the secondary transfer roller 81 differs from the load torque TL2, the black toner image needs to be large enough to cause the slip to occur at the nip portion between the secondary transfer roller 81 and the intermediate transfer belt 51.

Figure 11:
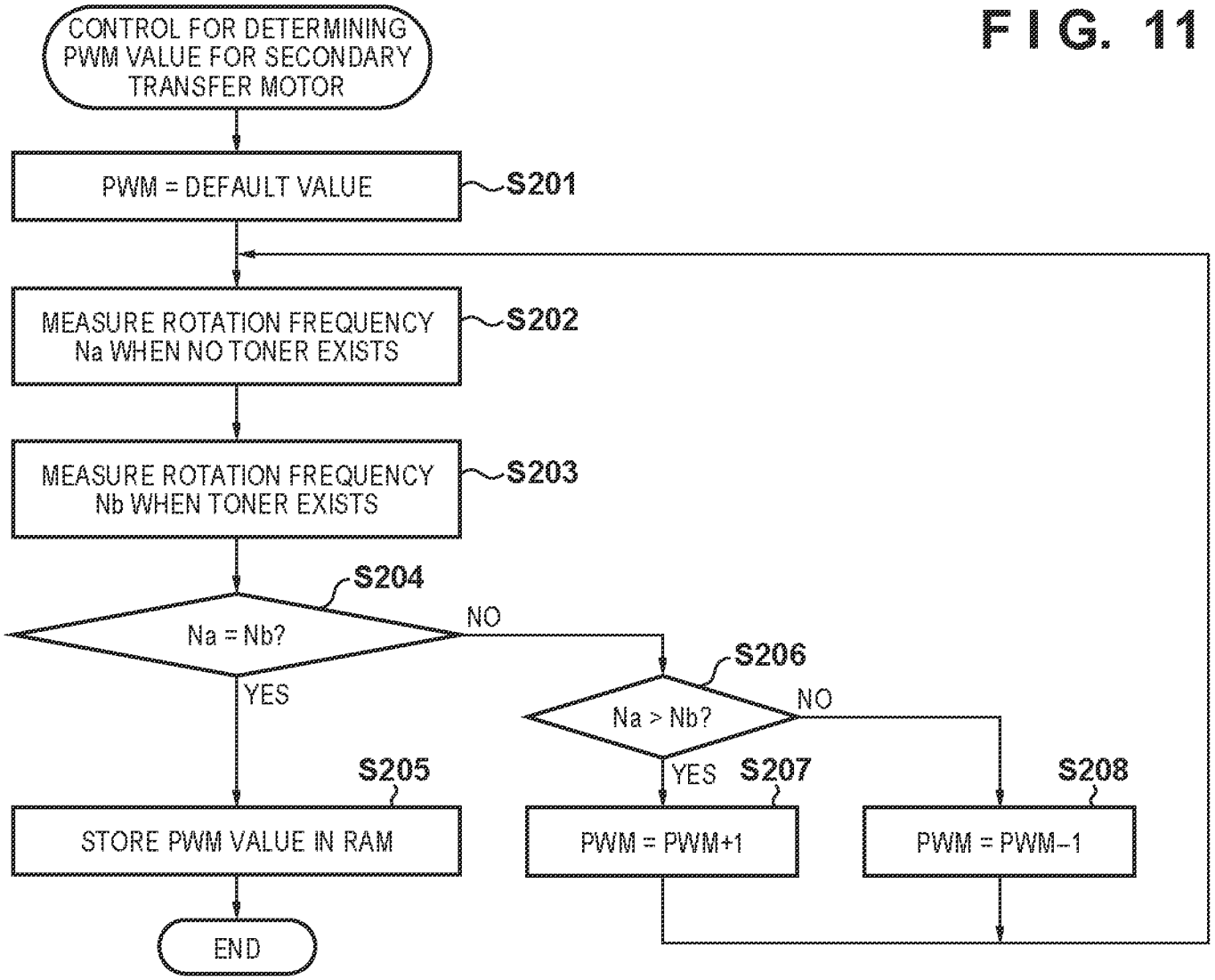
FIG. 11 is a flowchart for explaining control according to Embodiment 3.
Figure 12:
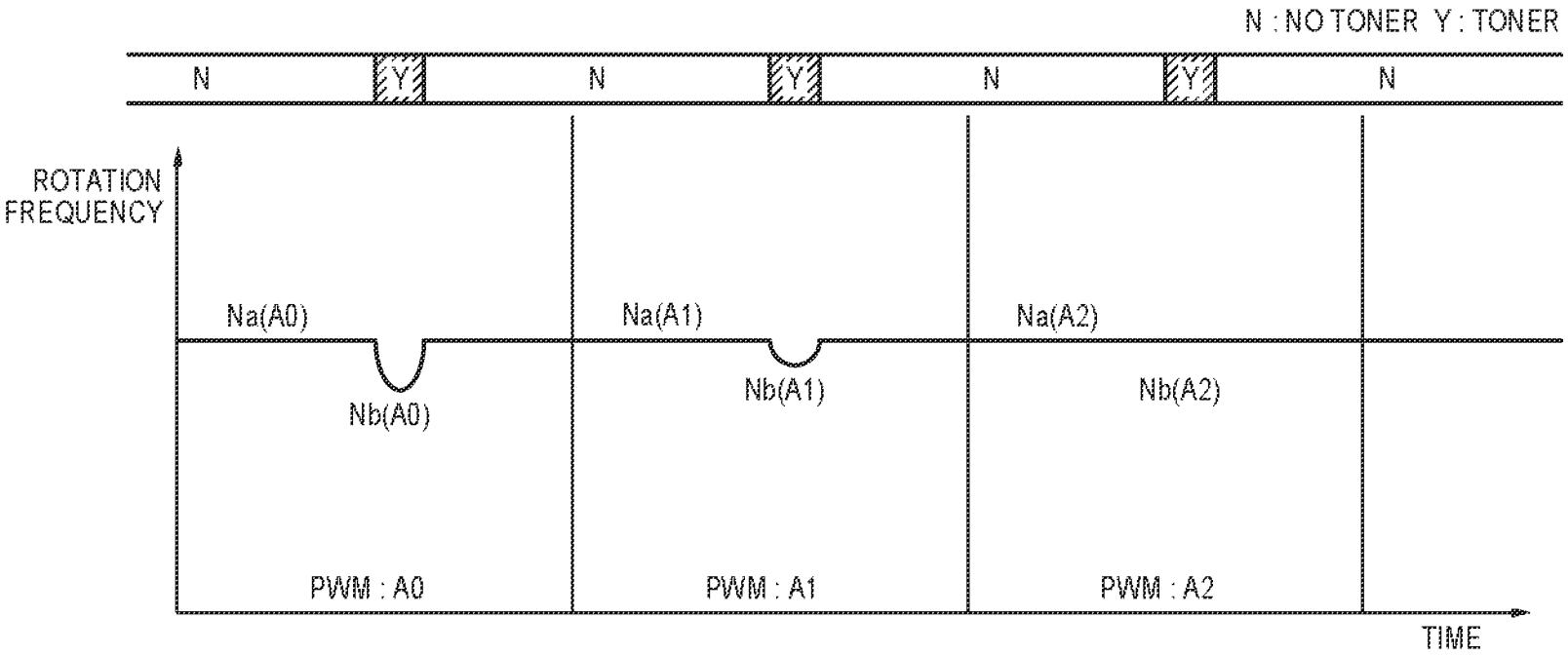
FIG. 12 is a diagram for explaining a specific example of control according to Embodiment 3.

The following is a specific description of a method for setting the PWM value that satisfies the relationship $TL2-Tm2 \leq uF$ when $TL2 \geq Tm2$, and the relationship $Tm2-TL2 < uF$ when $TL2 < Tm2$, with reference to FIGS. 11 and 12. FIG. 11 shows a control flow for determining the PWM value used to drive the secondary transfer motor 300.

In S201, the PWM value determination unit 125 sets a default value to the PWM value setting unit 153. Here, a nominal design value is used as the default value.

In S202, the PWM value determination unit 125 measures rotation frequencies N of the secondary transfer roller 81 over a predetermined section when no toner exists at the nip portion between the secondary transfer roller 81 and the intermediate transfer belt 51, and calculates an average value Na of the measured rotation frequencies N.

In S203, the PWM value determination unit 125 measures rotation frequencies N of the secondary transfer roller 81 over a predetermined section when toner images exist at the nip portion between the secondary transfer roller 81 and the intermediate transfer belt 51, and calculates an average value Nb of the measured rotation frequencies N. Prior to the measurement of rotation frequencies N, the CPU 121 controls the image forming apparatus 1 to form toner images on the intermediate transfer belt 51.

In S204, the PWM value determination unit 125 compares the average value Na of rotation frequencies measured when no toner image exists with the average value Nb of rotation frequencies measured when toner images exist to determine whether or not they are equal to each other. When Na=Nb, the processing moves to S205.

In S205, the PWM value determination unit 125 stores the PWM value at that point in the RAM 123 and ends the present control. On the other hand, when the result of determination is Na≠Nb in S204, the processing moves to S206.

In S206, the PWM value determination unit 125 determines whether or not the average value Na of rotation frequencies measured when no toner image exists is larger than the average value Nb of rotation frequencies measured when toner images exist. When Na>Nb, the processing moves to S207.

The PWM value determination unit 125 increments the PWM value by a predetermined value in S207, and then repeats the processing again from S202. On the other hand, when the result of determination is Na<Nb in S206, the processing moves to S208.

The PWM value determination unit 125 decrements the PWM value by a predetermined value in S208, and then repeats the processing again from S202.

Although the nominal design value is used as the default value for the PWM value in S201, a previous PWM value or the like may instead be used as the default value for the PWM value. Note that Na or Nb may have a predetermined range, or may be offset by a predetermined value so as to achieve the best image. In the former case, the processing moves to S205 when $Na-\Delta \leq Nb \leq Na+\Delta$. In the latter case, the processing moves to S205 when $Na-\Delta=Nb$.

FIG. 12 shows rotation frequencies of the secondary transfer roller 81 for the case where control is performed based on the control flow shown in FIG. 11. A more specific description will be given below with reference to FIG. 12. According to FIG. 12, the average value Na (A0) of rotation frequencies is the average value Na of rotation frequencies for the case where PWM value=A0h. The average value Nb (A0) of rotation frequencies is the average value Nb of rotation frequencies for the case where PWM value=A0h. After incrementing A0h by a predetermined value, A1h is obtained as the PWM value. When PWM value=A1h, the average values of rotation frequencies are Na (A1) and Nb (A1). According to FIG. 12, Na and Nb satisfy the following inequality relationships: Na (A0)>Nb (A0), and Na (A1)>Nb (A1). Therefore, the PWM value determination unit 125 increments the PWM value again. As a result, the PWM value equals A2h. When PWM value=A2h, the average values of rotation frequencies of the secondary transfer roller 81 are Na (A2) and Nb (A2). In FIG. 12, as the relationship Na (A2)=Nb (A2) holds, the PWM value determination unit 125 stores the PWM value, which is A2h, in the RAM 123 as the PWM value to be used at the time of normal printing. Note that in the present embodiment, for each PWM value, the average value Na of rotation frequencies of the secondary transfer roller 81 measured when no toner image exists at the nip portion is compared with the average value Nb of rotation frequencies of the secondary transfer roller 81 measured when toner images exist at the nip portion. Alternatively, the average value Na of rotation frequencies of the secondary transfer roller 81 measured when no toner image exists may be a predetermined fixed value. Furthermore, the supply of the toner image from the process cartridge is not limited to that from the black process cartridge PK. For example, the CPU 121 may eject waste toner onto the intermediate transfer belt 51 by controlling the high voltage control unit 14 to apply a reverse bias to the belt cleaner 58. This waste toner also functions as a lubricant as with the black toner.

Assume that the friction coefficient is u1 when neither a recording medium Q nor toner images exist between the secondary transfer roller 81 and the intermediate transfer belt 51. Also assume that the friction coefficient is u2 when both the recording medium Q and the toner exist therebetween, and u3 when only the toner exists therebetween. In this case, the relationship u1>u2>u3 holds. The relationship Na=Nb holds when the friction coefficient between the secondary transfer roller 81 and the intermediate transfer belt 51 is u3. This indicates that the secondary transfer roller 81 is acting as the follower of the intermediate transfer belt 51. That is to say, the relationship TL2−Tm2≤u3F or Tm2−TL2<u3F holds. The friction coefficient between the secondary transfer roller 81 and the intermediate transfer belt 51 is u2 when the recording medium Q and the toner exist therebetween at the time of printing. Furthermore, as the relationship u2>u3 holds, the relationship TL2−Tm2≤u2F or Tm2−TL2<u2F serves as the condition for the secondary transfer roller 81 to act as the follower of the intermediate transfer belt 51 at the time of printing.

As has been described above, the PWM value satisfying the follower condition can be determined by eliminating a difference between the rotation frequency of the secondary transfer roller 81 for the case where no toner image exists at the nip portion formed by the secondary transfer roller 81 and the intermediate transfer belt 51 and the rotation frequency of the secondary transfer roller 81 for the case where toner images exist at the nip portion formed by the secondary transfer roller 81 and the intermediate transfer belt 51. The PWM value of the secondary transfer motor 300 thus calculated may be periodically updated by the CPU 121, or may be stored in a nonvolatile memory and the like. An applied voltage control method may be used as the method for controlling the secondary transfer motor 300. Furthermore, although the above has described the relationship between the secondary transfer roller 81 and the intermediate transfer belt 51, Embodiment 3 is also applicable to the relationship between the secondary transfer belt and the intermediate transfer belt, and to the relationship between the photosensitive drums 61 and the intermediate transfer belt 51.

Embodiment 4

Embodiment 4 describes a method for correcting the PWM value used to drive the secondary transfer motor 300 in the case where the load torque TL2 on the secondary transfer roller 81 has fluctuated during printing, and abnormality processing for the case where the correction was not effective. Fluctuations in the load torque TL2 are reflected in the rotation frequency N of the secondary transfer roller 81. In view of this, in Embodiment 4, the CPU 121 compares the rotation frequency N of the secondary transfer roller 81 with two threshold ranges to determine whether or not the correction is necessary and whether or not an abnormality has occurred. For example, the CPU 121 functions as a first determination unit that determines whether or not the rotation frequency of the secondary transfer motor 300 has departed from a predetermined first threshold range. The CPU 121 also functions as a correction unit that, when the rotation frequency of the secondary transfer motor 300 has departed from the first threshold range, corrects the input voltage applied to the secondary transfer motor 300 or the PWM value set until the rotation frequency of the secondary transfer motor 300 falls within the first threshold range. The CPU 121 further functions as a second determination unit that determines whether or not the rotation frequency of the secondary transfer motor 300 has departed from a predetermined second threshold range. When the rotation frequency of the secondary transfer motor 300 has departed from the second threshold range, the CPU 121 notifies about the occurrence of the abnormality using a notification unit.

Figure 13:
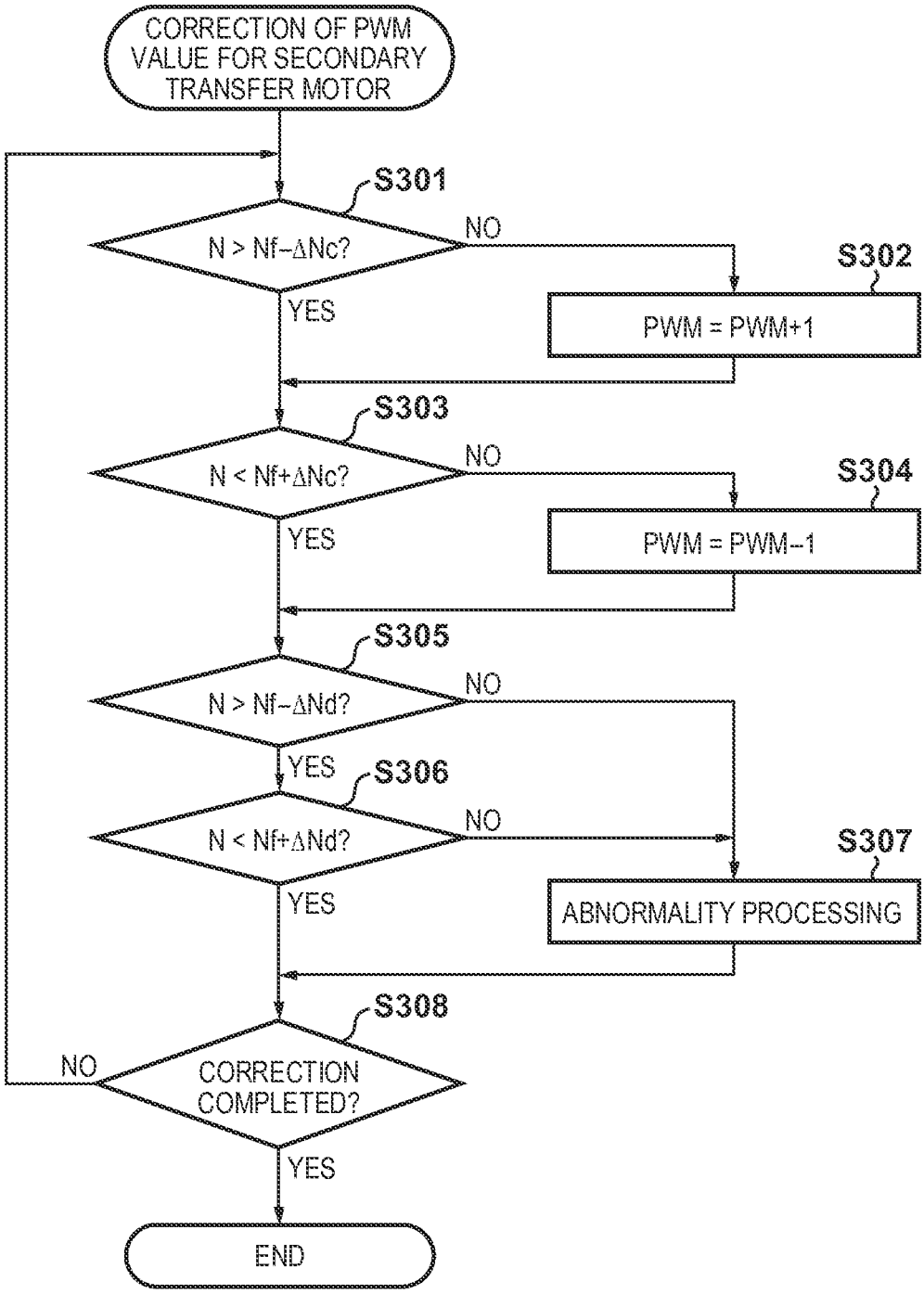
FIG. 13 is a flowchart for explaining control according to Embodiment 4.
Figure 14:
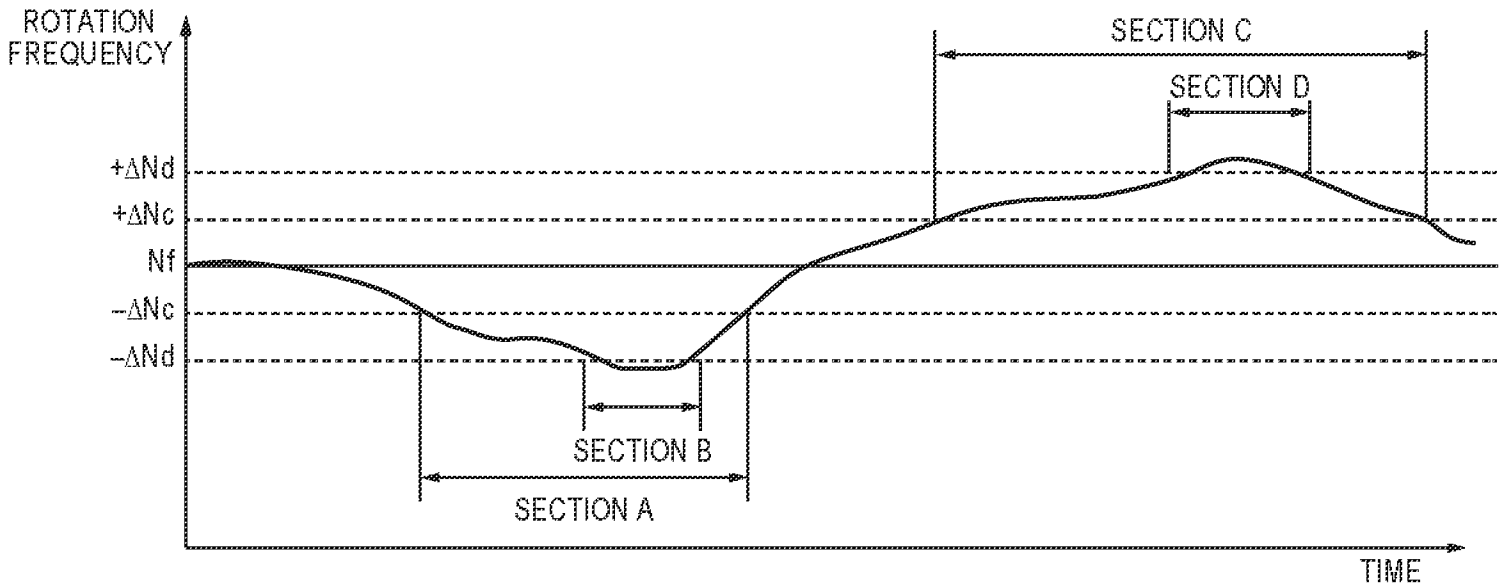
FIG. 14 is a diagram for explaining a specific example of control according to Embodiment 4.

FIG. 13 is a flowchart of correction of the PWM value used to drive the secondary transfer motor. Note, this correction is executed by the CPU 121. FIG. 14 shows a specific example for explaining in detail the correction of the PWM value used to drive the secondary transfer motor shown in FIG. 13. Rotation frequencies N of the secondary transfer roller 81 and thresholds for various corrections and abnormality detection are illustrated in FIG. 14. In FIGS. 13 and 14, a reference rotation frequency Nf is the rotation frequency that serves as the nominal value for the secondary transfer roller 81. Correction thresholds ΔNc are the thresholds used to determine whether or not to correct the PWM value used to drive the secondary transfer roller 81. The correction thresholds ΔNc are positive and negative values with the reference rotation frequency Nf at the center thereof. A value obtained from the expression Nf−ΔNc is referred to as a lower PWM correction threshold, whereas a value obtained from the expression Nf+ΔNc is referred to as an upper PWM correction threshold. As such, the reference rotation frequency Nf, which is the center value of the first threshold range, is the input voltage applied by the CPU 121 to the secondary transfer motor 300 or the PWM value set when the rotation frequency of the secondary transfer motor 300 has reached a predetermined value.

Abnormality thresholds ΔNd are the thresholds for detecting an abnormality in correction of the PWM value used to drive the secondary transfer roller 81. The abnormality thresholds ΔNd are also positive and negative values with the reference rotation frequency Nf at the center thereof. A value obtained from the expression Nf−ΔNd is referred to as a lower rotation frequency abnormality threshold, whereas a value obtained from the expression Nf+ΔNd is referred to as an upper rotation frequency abnormality threshold. The correction thresholds ΔNc and the abnormality thresholds ΔNd satisfy the relationship ΔNc<ΔNd. This is because the abnormality thresholds ΔNd are the thresholds for detecting a rotation frequency N that is too abnormal to be fixed by correction of the PWM value. As such, the center value of the second threshold range is also the reference rotation frequency Nf.

A description is now given of correction of the PWM value used to drive the secondary transfer motor based on FIG. 13. After the printing is started, once the intermediate transfer belt motor 200 and the secondary transfer motor 300 have been stabilized at a predetermined rotation speed, correction of the PWM value used to drive the secondary transfer motor is started.

In S301, the CPU 121 (PWM value determination unit 125) determines whether or not the rotation frequency N of the secondary transfer roller 81 detected using the rotation frequency detection unit 151 is larger than the lower PWM correction threshold (Nf−ΔNc). When the relationship N≤Nf−ΔNc is satisfied, the processing moves to S302.

The CPU 121 increments the PWM value by a predetermined value in S302. Thereafter, the processing moves to S303. On the other hand, when the relationship N>Nf−ΔNc is satisfied in S301, the processing skips S302 and moves to S303. More specifically, the CPU 121 increments the PWM value in section A shown in FIG. 14, and maintains the PWM value as-is in other sections.

In S303, the CPU 121 determines whether or not the rotation frequency N of the secondary transfer roller 81 is smaller than the upper PWM correction threshold (Nf+ΔNc). When the relationship N≥Nf+ΔNc is satisfied, the processing moves to S304.

The CPU 121 decrements the PWM value by a predetermined value in S304. Thereafter, the processing moves to S305. On the other hand, when the relationship N<Nf+ΔNc is satisfied, the processing skips S304 and moves to S305. More specifically, the CPU 121 decrements the PWM value in section C shown in FIG. 14, and maintains the PWM value as-is in other sections.

In S305, the CPU 121 determines whether or not the rotation frequency N of the secondary transfer roller 81 is larger than the lower rotation frequency abnormality threshold Nf−ΔNd. When the relationship N>Nf−ΔNd is satisfied, the processing moves to S306. When the relationship N≤Nf−ΔNd is satisfied, the processing moves to S307. In section B shown in FIG. 14, the CPU 121 executes the abnormality processing in S307. In other sections, the processing moves to S306.

In S306, the CPU 121 determines whether or not the rotation frequency N of the secondary transfer roller 81 is smaller than the upper rotation abnormality threshold Nf+ΔNd. When the relationship N<Nf+ΔNd is satisfied, the processing moves to S308. When the relationship N≥Nf+ΔNd is satisfied, the processing moves to S307.

In S307, the CPU 121 executes the abnormality processing. Note that the abnormality processing is to, for example, notify a device that is superordinate to the image forming apparatus 1 (e.g. a host computer) of the abnormality and stop the image forming apparatus 1. The abnormality processing also involves notification of the occurrence of the abnormality to the user using a display device and the like. For example, in section D shown in FIG. 14, the CPU 121 executes the abnormality processing. In other sections, the processing moves straight to S308.

In S308, the CPU 121 determines whether or not a predetermined correction completion condition is satisfied. When the correction completion condition is not satisfied, the CPU 121 repeats the processing again from S301. When the correction completion condition is satisfied, the correction processing is ended. The correction completion condition is, for example, completion of a print job and the occurrence of the abnormality processing.

Although the reference rotation frequency Nf has been described as the rotation frequency that serves as the nominal value in the present embodiment, the average rotation frequency of the secondary transfer roller 81 obtained while the secondary transfer roller 81 is normally rotating may instead be used as the reference rotation frequency Nf. Furthermore, although it has been described above that the upper and lower correction thresholds ΔNc have the same value and the upper and lower abnormality thresholds ΔNd have the same value, they may have difference values.

As has been described above, when the load torque TL2 on the secondary transfer roller 81 has fluctuated during printing, the CPU 121 corrects the rotation frequency N of the secondary transfer roller 81 to approach the reference rotation frequency Nf. This can alleviate the effects of fluctuations in the load torque TL2 on the image. Furthermore, as the CPU 121 notifies the operator of the abnormality in image formation via the display device, the operator can immediately learn of the abnormality in image formation. Moreover, when the abnormality has occurred, the CPU 121 instructs the exposure control unit 13, the high voltage control unit 14, the drive control unit 15, the fixing control unit 16, and so on, to stop. This can suppress wasteful consumption of recording media Q and toner.

Although Embodiment 4 has described a method for controlling the secondary transfer motor 300 using the PWM value, similar effects can be obtained when the voltage applied to the secondary transfer motor 300 is controlled instead. Furthermore, although the above has described the relationship between the secondary transfer roller 81 and the intermediate transfer belt 51, the present invention is also applicable to the relationship between the secondary transfer belt and the intermediate transfer belt, and to the relationship between the photosensitive drums 61 and the intermediate transfer belt 51. Although the display device has been described as the abnormality notification unit, an audio signal output device that outputs an audio signal notifying about the abnormality, or an electronic mail transmission device that transmits an electronic mail notifying about the abnormality, may instead be used as the abnormality notification unit because they both can notify the operator of the occurrence of the abnormality.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-218317, filed Sep. 30, 2011 which is hereby incorporated by reference herein in its entirety.

What is claimed is:

1. An apparatus comprising:

a first rotation member;

a second rotation member that rotates while being in indirect contact with the first rotation member via a medium or being in direct contact with the first rotation member without the medium;

a first drive motor that drives the first rotation member;

a second drive motor that drives the second rotation member;

a first control unit that controls the first drive motor to cause the first rotation member to rotate at a constant rotation frequency;

a second control unit configured to control the second drive motor;

a rotation frequency detection unit configured to detect a rotation frequency of the second drive motor, wherein the second control unit is further configured to determine, based on a detection result obtained by the rotation frequency detection unit when the first rotation member and the second rotation member are separated from each other, whether or not the second rotation member driven by the second drive motor satisfies a follower condition, to set to the second drive motor an input value which is supplied to the second drive motor for driving the second drive motor at a time when the detection result is obtained by the rotation frequency detection unit when the second rotation member satisfies the follower condition, and to change the input value and cause the rotation frequency detection unit to detect the rotation frequency of the second drive motor, and wherein the follower condition is defined so that the second rotation member follows the first rotation member rotating at a constant rotation frequency when the first rotation member and the second rotation member are in contact with each other, a first determination unit that determines whether or not a rotation frequency of the second drive motor has departed from a predetermined first threshold range; and a correction unit that, when the rotation frequency of the second drive motor has departed from the first threshold range, corrects as the input value an input voltage applied to the second drive motor or a PWM value until the rotation frequency of the second drive motor falls within the first threshold range.

2. The apparatus according to claim 1 further comprising:

a contact/separation unit that causes the first rotation member and the second rotation member to come in contact with each other and to be separated from each other, wherein the second control unit drives the second drive motor while the contact/separation unit has the first rotation member and the second rotation member separated from each other, holds as the input value an input voltage applied to the second drive motor or a pulse wave modulation (PWM) value set when the rotation frequency of the second drive motor equals a predetermined value, and uses the held input voltage or PWM value at the time of printing.

3. The apparatus according to claim 1, wherein a center value of the first threshold range is an input voltage applied to the second drive motor or a PWM value as the input value that is held by the second control unit when the rotation frequency of the second drive motor equals a predetermined value.

4. The apparatus according to claim 1 further comprising:

a second determination unit that determines whether or not a rotation frequency of the second drive motor has departed from a predetermined second threshold range; and a notification unit that notifies about occurrence of an abnormality when the rotation frequency of the second drive motor has departed from the second threshold range.

5. The apparatus according to claim 4, wherein a center value of the second threshold range is an input voltage applied to the second drive motor or a PWM value as the input value that is held by the second control unit when the rotation frequency of the second drive motor equals a predetermined value.

6. The apparatus according to claim 1, wherein the first rotation member is an intermediate transfer member to which toner images are transferred from an image carrier.

7. The apparatus according to claim 1, wherein the first rotation member is an intermediate transfer belt to which toner images are transferred from an image carrier.

8. The apparatus according to claim 1, wherein the first rotation member is an opposition roller that is positioned facing the second rotation member.

9. The apparatus according to claim 1, wherein the second rotation member is a transfer member that transfers toner images from the first rotation member to a recording medium.

10. The apparatus according to claim 1, wherein the second rotation member is a transfer belt that transfers toner images from the first rotation member to a recording medium.

11. The apparatus according to claim 1 further comprising:

an application unit that applies a lubricant to a circumferential surface of the first rotation member;

wherein the rotation frequency detection unit detects a first rotation frequency of the second drive motor when the lubricant is applied to the circumferential surface of the first rotation member, and a second rotation frequency of the second drive motor when the lubricant is not applied to the circumferential surface of the first rotation member;

a comparison unit that compares the first rotation frequency with the second rotation frequency;

an adjustment unit that adjusts an input voltage applied to the second drive motor or a PWM value as the input value until the first rotation frequency and the second rotation frequency match; and a holding unit that holds the input voltage or the PWM value at the time when the first rotation frequency and the second rotation frequency match, wherein the second control unit uses the input voltage or the PWM value held by the holding unit at the time of printing.

12. The apparatus according to claim 11, wherein the lubricant includes toner.

13. An apparatus comprising:

a first rotation member;

a second rotation member that rotates while being in indirect contact with the first rotation member via a medium or being in direct contact with the first rotation member without the medium;

a first drive motor that drives the first rotation member;

a second drive motor that drives the second rotation member;

a first control unit that controls the first drive motor to cause the first rotation member to rotate at a constant rotation frequency;

a second control unit configured to control the second drive motor;

a rotation frequency detection unit configured to detect a rotation frequency of the second drive motor; and an image forming unit that forms toner images on a circumferential surface of the first rotation member, wherein the second control unit is further configured to determine, based on a detection result obtained by the rotation frequency detection unit when the toner images formed by the image forming unit on the circumferential surface of the first rotation member pass a point of contact between the first rotation member and the second rotation member, whether or not the second rotation member driven by the second drive motor satisfies a follower condition, to set to the second drive motor an input value which is supplied to the second drive motor for driving the second drive motor at a time when the detection result is obtained by the rotation frequency detection unit when the second rotation member satisfies the follower condition, and to change the input value and cause the rotation frequency detection unit to detect the rotation frequency of the second drive motor, and wherein the follower condition is defined so that the second rotation member follows the first rotation member rotating at a constant rotation frequency when the first rotation member and the second rotation member are in contact with each other, a first determination unit that determines whether or not a rotation frequency of the second drive motor has departed from a predetermined first threshold range; and a correction unit that, when the rotation frequency of the second drive motor has departed from the first threshold range, corrects as the input value an input voltage applied to the second drive motor or a PWM value until the rotation frequency of the second drive motor falls within the first threshold range.

14. An image forming apparatus comprising:

a first rotation member;

a second rotation member that rotates while being in indirect contact with the first rotation member via a medium or being in direct contact with the first rotation member without the medium;

an image forming unit that forms toner images on a circumferential surface of the first rotation member;

a first drive motor that drives the first rotation member;

a second drive motor that drives the second rotation member;

a first control unit that controls the first drive motor to cause the first rotation member to rotate at a constant rotation frequency;

a second control unit configured to control the second drive motor;

a rotation frequency detection unit that detects a rotation frequency of the second drive motor, the second control unit is further configured to determine, based on a detection result obtained by the rotation frequency detection unit when the first rotation member and the second rotation member are separated from each other, whether or not the second rotation member driven by the second drive motor satisfies a follower condition, to set to the second drive motor an input value which is supplied to the second drive motor for driving the second drive motor at a time when the detection result is obtained by the rotation frequency detection unit when the second rotation member satisfies the follower condition, and to change the input value and cause the rotation frequency detection unit to detect the rotation frequency of the second drive motor, and wherein the follower condition is defined so that the second rotation member follows the first rotation member rotating at a constant rotation frequency when the first rotation member and the second rotation member are in contact with each other, a first determination unit that determines whether or not a rotation frequency of the second drive motor has departed from a predetermined first threshold range; and a correction unit that, when the rotation frequency of the second drive motor has departed from the first threshold range, corrects an input voltage applied to the second drive motor or a PWM value as the input value until the rotation frequency of the second drive motor falls within the first threshold range.

15. The image forming apparatus according to claim 14, wherein a center value of the first threshold range is an input voltage applied to the second drive motor or a PWM value that is held by the second control unit when the rotation frequency of the second drive motor equals a predetermined value.

16. The image forming apparatus according to claim 14 further comprising:

a contact/separation unit that causes the first rotation member and the second rotation member to come in contact with each other and to be separated from each other, wherein the second control unit drives the second drive motor while the contact/separation unit has the first rotation member and the second rotation member separated from each other, holds an input voltage applied to the second drive motor or a pulse wave modulation (PWM) value set when the rotation frequency of the second drive motor equals a predetermined value, and uses the held input voltage or PWM value at the time of printing.

17. The image forming apparatus according to claim 14 further comprising:

a second determination unit that determines whether or not a rotation frequency of the second drive motor has departed from a predetermined second threshold range; and a notification unit that notifies about occurrence of an abnormality when the rotation frequency of the second drive motor has departed from the second threshold range.

18. The image forming apparatus according to claim 17, wherein a center value of the second threshold range is an input voltage applied to the second drive motor or a PWM value that is held by the second control unit when the rotation frequency of the second drive motor equals a predetermined value.

* * * * *